US012570494B2

(12) United States Patent
Matsumoto et al.

(10) Patent No.: US 12,570,494 B2
(45) Date of Patent: Mar. 10, 2026

(54) RECORDING MEDIUM PROCESSING APPARATUS AND IMAGE FORMING SYSTEM

(71) Applicant: FUJIFILM BUSINESS INNOVATION CORP., Tokyo (JP)

(72) Inventors: Masashi Matsumoto, Kanagawa (JP); Takumi Uegane, Kanagawa (JP); Takayuki Uchiyama, Kanagawa (JP); Mitsuhiro Nakamura, Kanagawa (JP); Taichi Fuchu, Kanagawa (JP)

(73) Assignee: FUJIFILM BUSINESS INNOVATION CORP., Tokyo (JP)

( * ) Notice: Subject to any disclaimer, the term of this patent is extended or adjusted under 35 U.S.C. 154(b) by 537 days.

(21) Appl. No.: 17/903,715

(22) Filed: Sep. 6, 2022

(65) Prior Publication Data

US 2023/0294949 A1 Sep. 21, 2023

(30) Foreign Application Priority Data

Mar. 15, 2022 (JP) ..... 2022-040212

(51) Int. Cl.
*B65H 37/04* (2006.01)

(52) U.S. Cl.
CPC ... *B65H 37/04* (2013.01); *B65H 2301/43828* (2013.01); *B65H 2301/51616* (2013.01); *B65H 2801/27* (2013.01)

(58) Field of Classification Search
CPC ..... B65H 37/04; B65H 2301/5142; B65H 2301/51616; B65H 2301/43828; B65H 2801/27; G03G 15/6544; G03G 2215/00852; B31F 1/07; B31F 1/36; B31F 5/02; B31F 2201/0754; B31F 2201/0771; B31F 2201/0784
USPC ..... 270/58.08
See application file for complete search history.

(56) References Cited

U.S. PATENT DOCUMENTS

| | | | | |
|---|---|---|---|---|
| 9,259,894 | B2 * | 2/2016 | Abe | B65H 37/04 |
| 10,603,945 | B2 * | 3/2020 | Matsumoto | B42B 4/00 |
| 10,954,093 | B2 * | 3/2021 | Susaki | B65H 37/04 |
| 11,097,919 | B2 | 8/2021 | Matsumoto et al. | |
| 11,130,308 | B2 * | 9/2021 | Suzuki | B65H 37/04 |

FOREIGN PATENT DOCUMENTS

| | | |
|---|---|---|
| JP | 2015-199235 A | 11/2015 |
| JP | 2021-70172 A | 5/2021 |

OTHER PUBLICATIONS

Dec. 16, 2025 Office Action issued in Japanese Patent Application No. 2022-040212.

* cited by examiner

*Primary Examiner* — Leslie A Nicholson, III
(74) *Attorney, Agent, or Firm* — OLIFF PLC

(57) ABSTRACT

A recording medium processing apparatus includes: first teeth to be used in a process of binding a recording medium bundle; second teeth to be moved toward the first teeth to press the recording medium bundle positioned between the first teeth and the second teeth; and a moving unit that includes a screw moving unit that moves the second teeth with respect to the first teeth by rotating a screw in a circumferential direction, the screw being meshed with an interlocking portion interlocked with the second teeth. A moving speed of the second teeth being moved by the moving unit is varied.

20 Claims, 22 Drawing Sheets

RECORDING MEDIUM PROCESSING APPARATUS AND IMAGE FORMING SYSTEM

CROSS-REFERENCE TO RELATED APPLICATIONS

This application is based on and claims priority under 35 USC 119 from Japanese Patent Application No. 2022-040212 filed Mar. 15, 2022.

BACKGROUND

(i) Technical Field

The present disclosure relates to a recording medium processing apparatus and an image forming system.

(ii) Related Art

Japanese Unexamined Patent Application Publication No. 2021-70172 discloses a binding device that binds a recording material bundle using first teeth and second teeth that are movable toward the first teeth to press the recording material bundle which is positioned between the first teeth and the second teeth. In the binding device, trapezoidal threads meshed with an interlocking portion interlocked with the second teeth are rotated to move the second teeth with respect to the first teeth.

SUMMARY

A process of binding a recording medium bundle is occasionally performed with teeth pressed against the recording medium bundle.

In the case where the teeth to be used in the process of binding a recording medium bundle are moved by rotating threads in the circumferential direction, the productivity of the binding process may be reduced if the speed of movement of the teeth is constant.

Aspects of non-limiting embodiments of the present disclosure relate to suppressing a reduction in the productivity of a binding process compared to the case where the speed of movement of teeth to be used in the binding process is not varied.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a recording medium processing apparatus including: first teeth to be used in a process of binding a recording medium bundle; second teeth to be moved toward the first teeth to press the recording medium bundle positioned between the first teeth and the second teeth; and a moving unit that includes a screw moving unit that moves the second teeth with respect to the first teeth by rotating a screw in a circumferential direction, the screw being meshed with an interlocking portion interlocked with the second teeth, in which a moving speed of the second teeth being moved by the moving unit is varied.

BRIEF DESCRIPTION OF THE DRAWINGS

Exemplary embodiments of the present disclosure will be described in detail based on the following figures, wherein.

DETAILED DESCRIPTION

First Exemplary Embodiment

A first exemplary embodiment of the present disclosure will be described in detail below with reference to the accompanying drawings.

Figure 1:
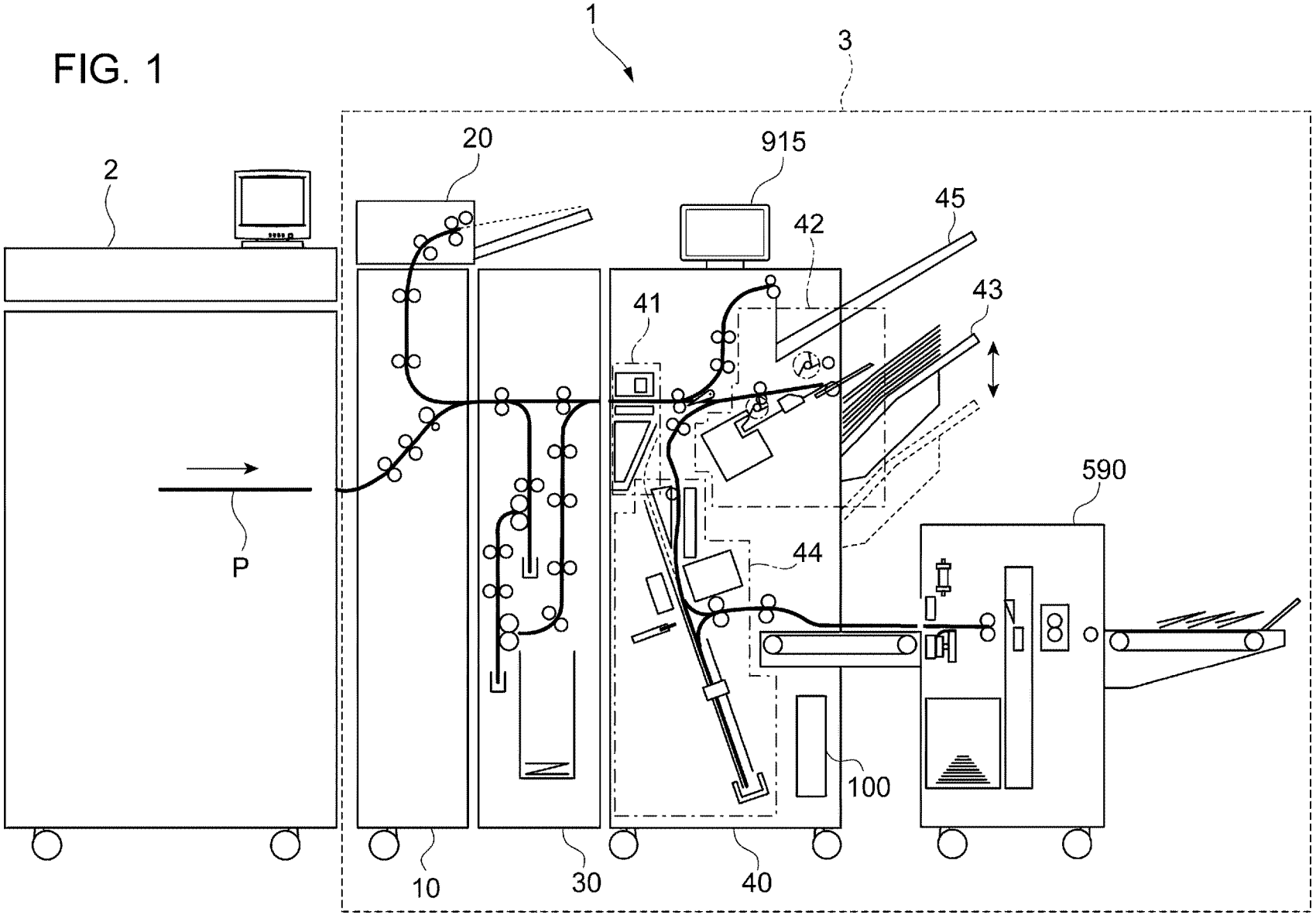
FIG. 1 illustrates the overall configuration of an image forming system.

FIG. 1 illustrates the overall configuration of an image forming system 1.

The image forming system 1 illustrates in FIG. 1 includes an image forming apparatus 2 that forms an image on paper P that serves as an example of a recording medium, and a paper processing device 3 that performs a process determined in advance on the paper P on which an image has been formed by the image forming apparatus 2.

The image forming apparatus 2 forms an image on the paper P using electrophotography or an ink jet system.

The paper processing device 3 which serves as an example of a recording medium processing apparatus is provided with a transport device 10 that transports the paper P output from the image forming apparatus 2 to the downstream side, and an interleaf paper supply device 20 that supplies interleaf paper such as cardboard and windowed paper P to the paper P transported by the transport device 10.

The paper processing device 3 is also provided with a folding device 30 that inwardly folds the paper P transported from the transport device 10 in three (C fold), outwardly folds the paper P in three (Z fold), etc.

The paper processing device 3 is also provided with a first post-processing device 40 provided downstream of the folding device 30 to perform punching, edge binding, saddle stitching, etc. on the paper P. For an additional description, the first post-processing device 40 provided downstream of the folding device 30 performs a process on a paper bundle (an example of a recording medium bundle) formed from a plurality of sheets of the paper P on which an image has been formed by the image forming apparatus 2, and performs a process on each sheet of the paper P.

The paper processing device 3 is also provided with a second post-processing device 590 provided downstream of the first post-processing device 40 to further perform a process on the paper bundle that has been folded in the middle or subjected to saddle stitching.

The paper processing device 3 is also provided with an information processing section 100 constituted from a central processing unit (CPU) that executes a program to serve as an example of a control unit that controls the entire paper processing device 3.

The first post-processing device 40 is provided with a punching unit 41 that performs punching on the paper P, and an edge-binding stapler unit 42 that binds an edge of a paper bundle.

The first post-processing device 40 is also provided with a first loading section 43 on which the paper P that has passed through the edge-binding stapler unit 42 is to be loaded, and a second loading section 45 on which the paper P that is not processed by the first post-processing device 40 or the paper P that has been subjected to only punching is to be loaded.

The first post-processing device 40 is further provided with a saddle-stitching unit 44 that folds a paper bundle in the middle and performs saddle stitching to fabricate a double-spread booklet.

Figure 2:
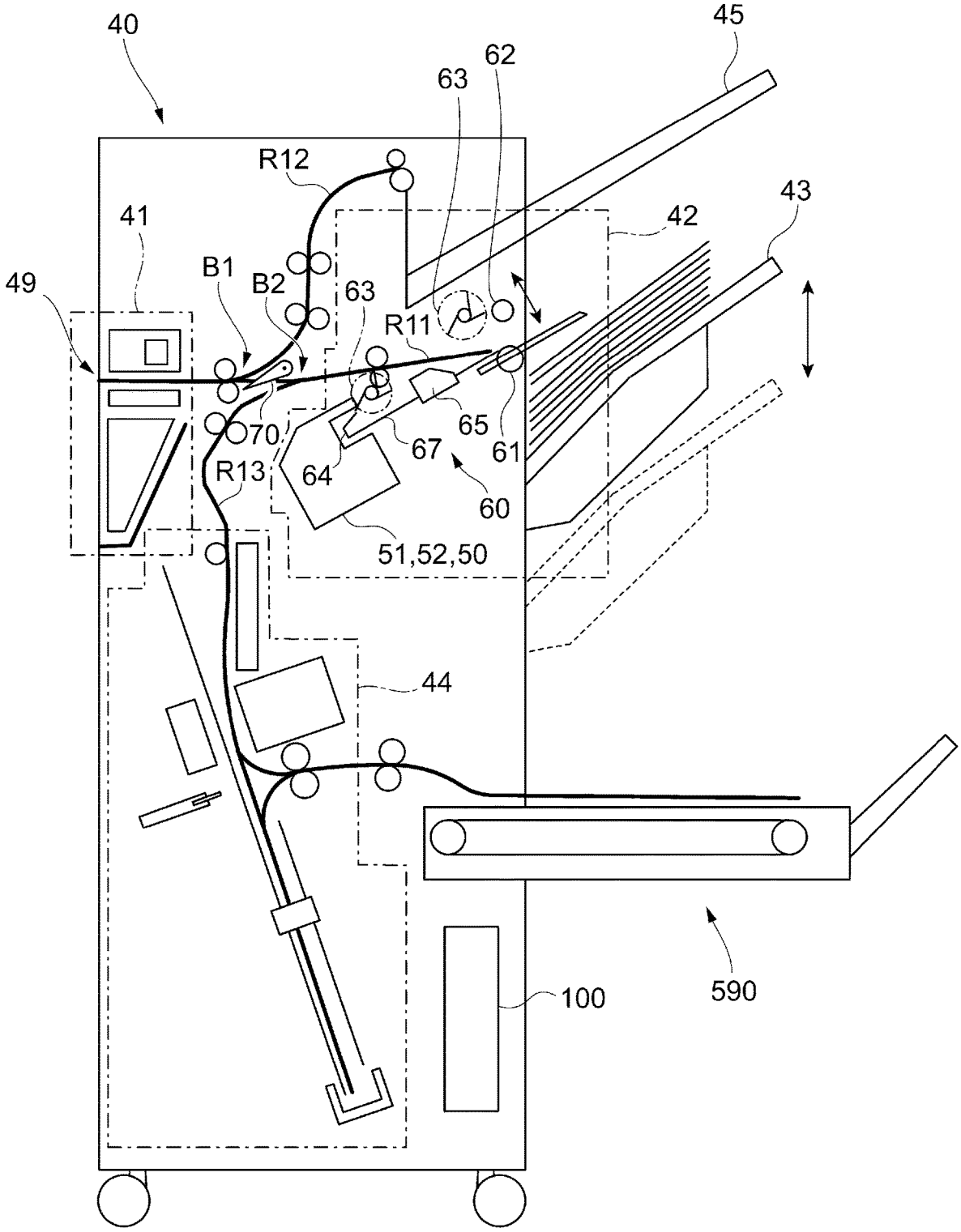
FIG. 2 illustrates the configuration of a first post-processing device.

FIG. 2 illustrates the configuration of the first post-processing device 40.

The first post-processing device 40 is provided with a reception port 49 that receives the paper P transported from the folding device 30. The punching unit 41 is provided directly after the reception port 49. The punching unit 41 punches the paper P transported to the first post-processing device 40 to form two holes, four holes, etc.

A first paper transport path R11 is provided to extend from the reception port 49 to the edge-binding stapler unit 42, and used to transport the paper P received at the reception port 49 to the edge-binding stapler unit 42.

Further, a second paper transport path R12 is provided as branched from the first paper transport path R11 at a first branch section B1, and used to transport the paper P to the second loading section 45.

In addition, a third paper transport path R13 is provided as branched from the first paper transport path R11 at a second branch section B2, and used to transport the paper P to the saddle-stitching unit 45.

A switching gate 70 is provided to switch (set) the destination of transport of the paper P to one of the first paper transport path R11 to the third paper transport path R13.

The edge-binding stapler unit 42 is provided with a paper stacking section 60 that allows a necessary number of sheets of the paper P to be stacked on each other to generate a paper bundle.

The paper stacking section 60 is provided with a support plate 67 disposed as inclined with respect to the horizontal direction to support the paper P transported thereto from below. In the present exemplary embodiment, a paper bundle is generated on the support plate 67.

The edge-binding stapler unit 42 is further provided with binding devices 50 that execute binding (edge binding) on an end portion of the paper bundle generated by the paper stacking section 60.

In the present exemplary embodiment, as discussed later, the edge-binding stapler unit 42 is provided with two binding devices 50, namely a first binding device 51 that performs a binding process using a staple and a second binding device 52 that performs a binding process without using a staple.

The edge-binding stapler unit 42 is also provided with a transport roller 61 rotationally driven to feed the paper bundle generated by the paper stacking section 60 to the first loading section 43. The edge-binding stapler unit 42 is further provided with a movable roller 62 that is movable to a position at which the movable roller 62 is retracted from the transport roller 61 and a position at which the movable roller 62 is in press contact with the transport roller 61.

When a process is to be performed by the edge-binding stapler unit 42, the reception port 49 first receives the paper P transported thereto.

After that, the paper P is transported along the first paper transport path R11, and reaches the edge-binding stapler unit 42.

Then, the paper P is transported to a location above the support plate 67, and thereafter falls down to the support plate 67. The paper P is supported by the support plate 67 from below, and moved to slide on the support plate 67 by an inclined rotary member 63 provided to the support plate 67.

After that, the paper P abuts against an end guide 64 attached to an end portion of the support plate 67. For an additional description, in the present exemplary embodiment, the end guide 64 which extends upward in the drawing is provided at an end portion of the support plate 67, and the paper P moved on the support plate 67 abuts against the end guide 64.

Consequently, movement of the paper P is stopped in the present exemplary embodiment. Subsequently, this operation is performed each time the paper P is transported from the upstream side, and a paper bundle of aligned sheets of the paper P is generated on the support plate 67.

In the present exemplary embodiment, a paper width position alignment member 65 is further provided to align the position of the paper bundle in the width direction.

In the present exemplary embodiment, end portions (side portions) of sheets of the paper P in the width direction are pressed by the paper width position alignment member 65 to align the position of the sheets of the paper P (paper bundle) in the width direction each time the paper P is supplied onto the support plate 67.

When the support plate 67 is loaded with a number of sheets of the paper P, the number being determined in advance, binding is executed on an end portion of the paper bundle by the first binding device 51 or the second binding device 52.

The first binding device 51 executes binding by driving a staple (U-shaped staple) made of metal into the paper bundle. The second binding device 52 executes binding by sandwiching the paper bundle between two arrays of binding teeth to pressure-bond the sheets of paper that constitute the paper bundle to each other.

After that, in the present exemplary embodiment, the movable roller 62 is advanced toward the transport roller 61, and the paper bundle is sandwiched between the movable roller 62 and the transport roller 61. After that, the transport roller 61 is rotationally driven so that the paper bundle is transported to the first loading section 43.

The first binding device 51 and the second binding device 52 are provided so as to be movable toward the back side and the front side of the sheet surface of the drawing so that a binding process may be performed on the paper P at a plurality of locations in the present exemplary embodiment.

A further description will be made with reference to FIG. 3 (which illustrates the paper stacking section 60 as seen from above). In the present exemplary embodiment, as described above, the first binding device 51 and the second binding device 52 are provided.

The first binding device 51 and the second binding device 52 are disposed at different positions from each other in the direction of the depth of the first post-processing device 40.

In the present exemplary embodiment, the first binding device 51 and the second binding device 52 are moved along the direction of the depth of the first post-processing device 40, which is orthogonal to the direction of transport of the paper P (paper bundle).

In the present exemplary embodiment, the first binding device 51 and the second binding device 52 are moved along a single common path.

In the present exemplary embodiment, the first binding device 51 and the second binding device 52 are movable, and a binding process may be performed on the paper bundle at a plurality of locations.

Figure 3:
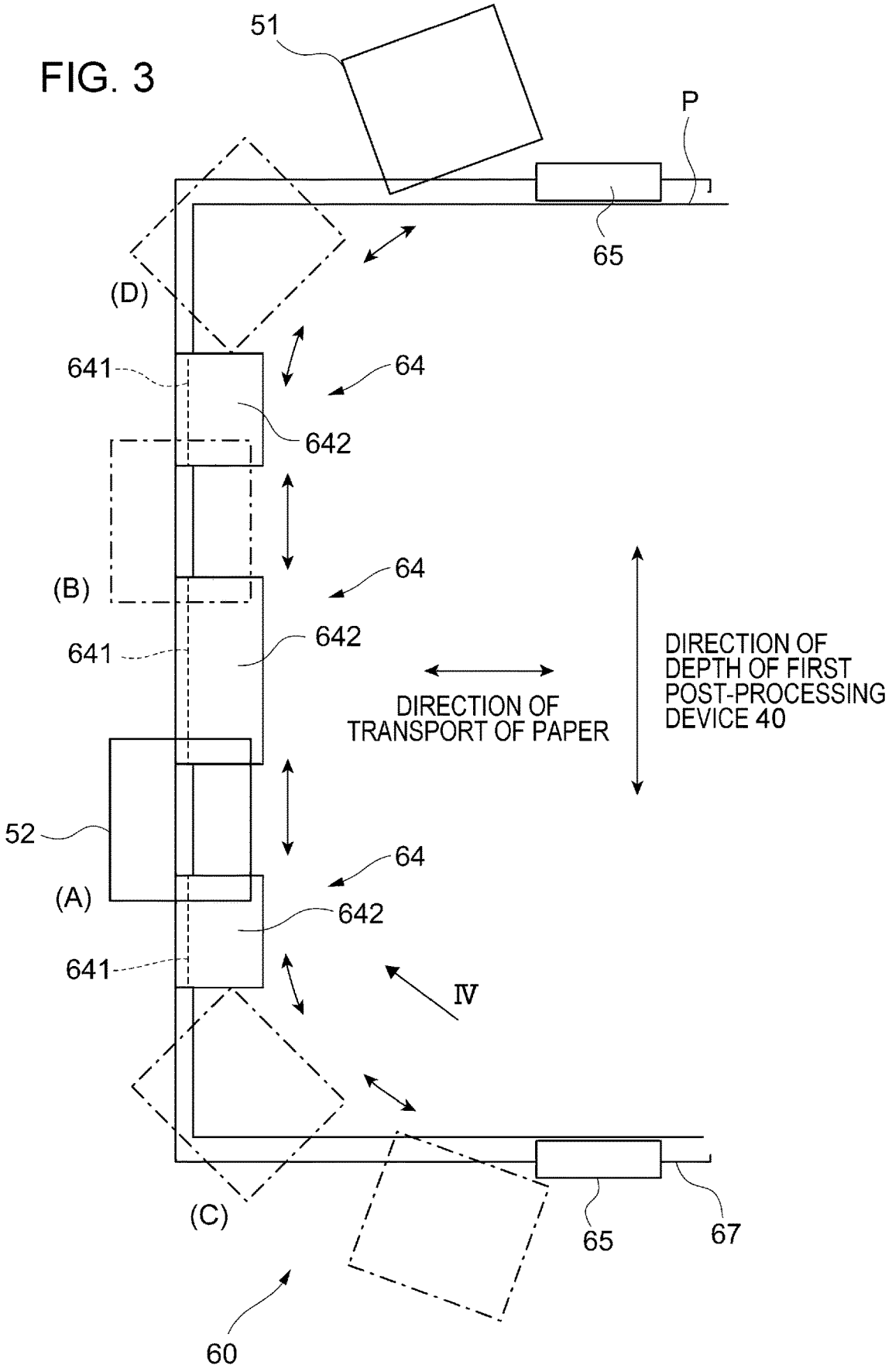
FIG. 3 illustrates a paper stacking section as seen from above.

Each of the first binding device 51 and the second binding device 52 stops at two different points (position (A) and position (B) in FIG. 3) from each other in the direction of the depth of the first post-processing device 40, for example, and performs a binding process (two-point binding process) at the two points.

In addition, each of the first binding device 51 and the second binding device 52 stops at one end of the paper bundle (one corner portion of the paper bundle) (position (D) in FIG. 3), for example, and performs a binding process (one-point binding process) at the stopped position.

In addition, each of the first binding device 51 and the second binding device 52 stops at the other end of the paper bundle (the other corner portion of the paper bundle) (position (C) in FIG. 3), for example, and performs a binding process (one-point binding process) at the stopped position.

In the present exemplary embodiment, each of the first binding device 51 and the second binding device 52 moves linearly between the position (A) and the position (B). However, each of the first binding device 51 and the second binding device 52 moves while rotating by 45°, for example, between the position (A) and the position (C) and between the position (B) and the position (D).

In the present exemplary embodiment, as illustrated in FIG. 3, a plurality of end guides 64 are provided.

The end guides 64 are disposed at different locations from each other in the direction of the depth of the first post-processing device 40 (direction that is orthogonal to the direction of transport of the paper P).

As illustrated in FIG. 3, each of the end guides 64 includes a regulation section 641 and a facing piece 642.

The regulation section 641 is disposed to be orthogonal to the support plate 67. In the present exemplary embodiment, movement of the paper P is regulated with an end portion of the paper P abutting against the regulation section 641.

The facing piece 642 is disposed so as to be connected to the regulation section 641 and face the support plate 67.

In the present exemplary embodiment, when the paper P is placed on the support plate 67, an end portion of the paper P is inserted between the facing piece 642 and the support plate 67. Further, the end portion of the paper P abuts against the regulation section 641. Consequently, sheets of the paper P are aligned.

When a binding process is performed at the position (A) in FIG. 3, the binding process is performed through a gap formed between the facing piece 642 positioned at the middle (middle in the up-down direction) in FIG. 3 and the facing piece 642 positioned on the lower side in the drawing.

When a binding process is performed at the position (B) in FIG. 3, meanwhile, the binding process is performed through a gap formed between the facing piece 642 positioned on the upper side in FIG. 3 and the facing piece 642 positioned at the middle in the drawing.

Figure 4:
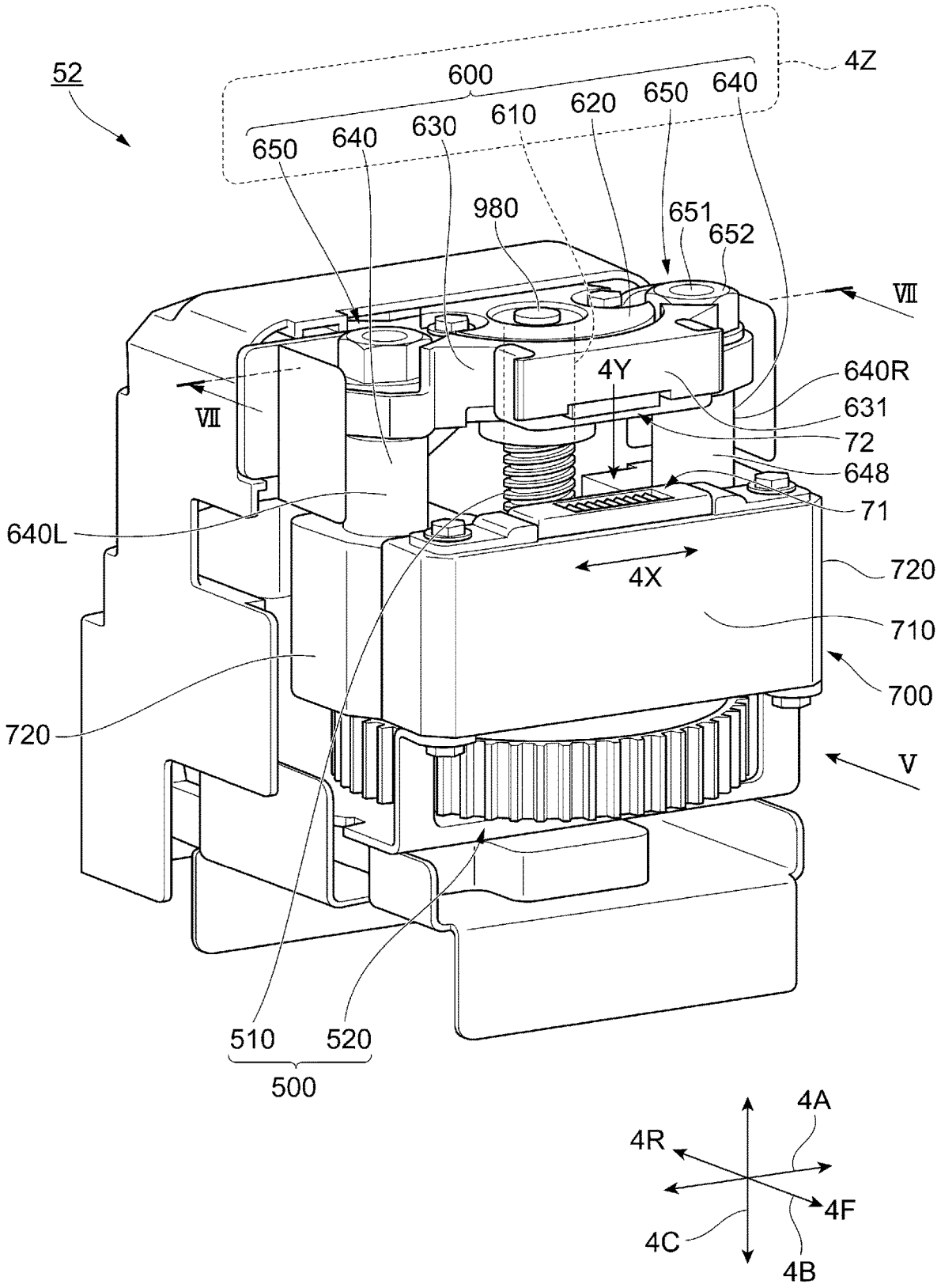
FIG. 4 illustrates a second binding device as seen in a direction indicated by an arrow IV in FIG. 3.
Figure 5:
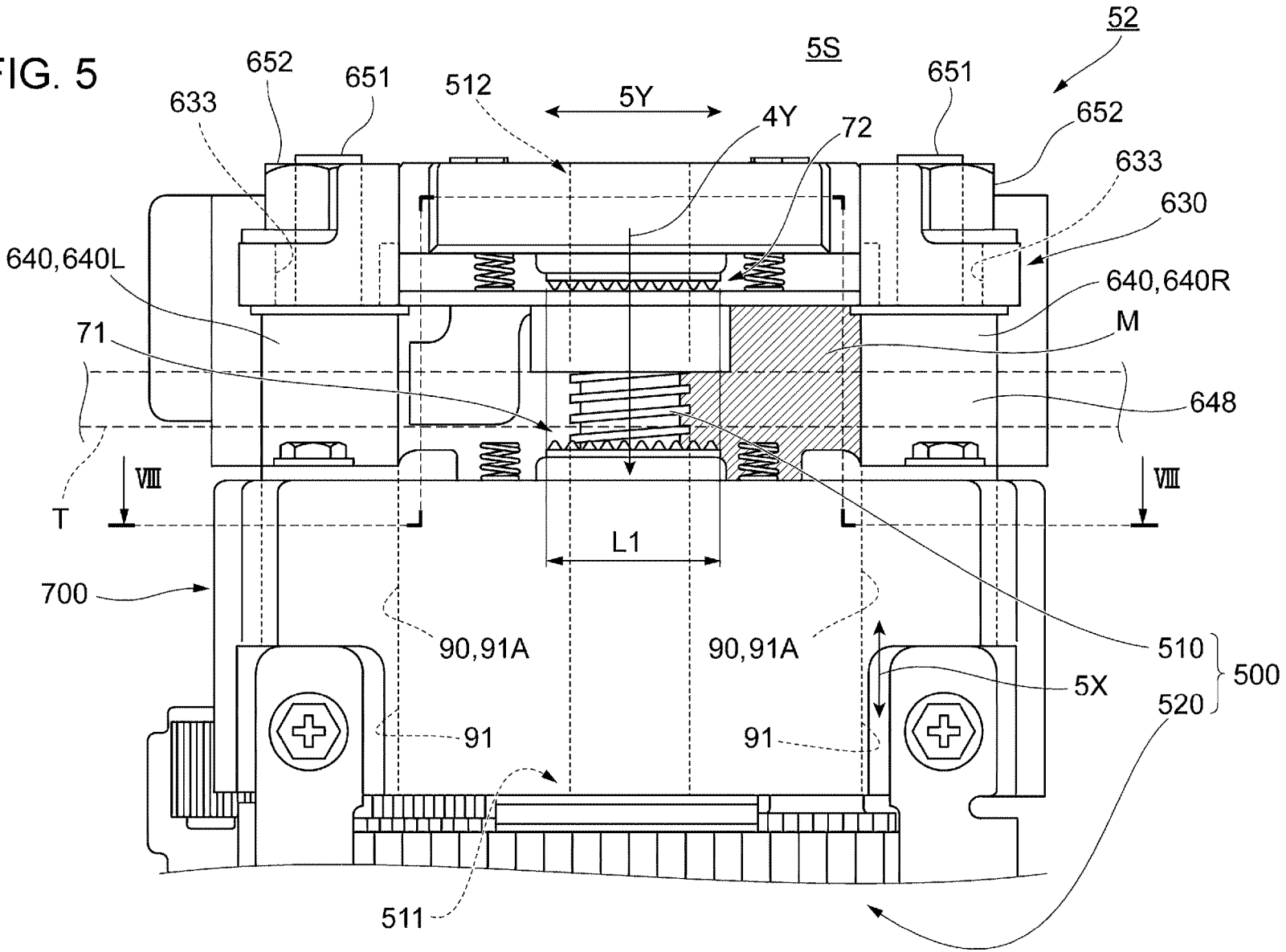
FIG. 5 illustrates the second binding device as seen in a direction of an arrow V in FIG. 4.

FIG. 4 illustrates the second binding device 52 as seen in a direction indicated by an arrow IV in FIG. 3. FIG. 5 illustrates the second binding device 52 as seen in a direction of an arrow V in FIG. 4. For an additional description, FIG. 5 illustrates the second binding device 52 as seen from the front.

The direction indicated by an arrow 4A in FIG. 4 will be referred to as a width direction of the second binding device 52, and the direction indicated by an arrow 4B will be referred to as a depth direction of the second binding device 52. The direction indicated by an arrow 4C will be referred to as a direction of the height of the second binding device 52.

Herein, the direction indicated by an arrow 4R in the drawing will be referred to as a rear direction or a rear side, and the direction indicated by an arrow 4F in the drawing will be referred to as a front direction or a front side.

As illustrated in FIG. 4, the second binding device 52 is provided with first binding teeth 71 that are used for a binding process for a paper bundle T (see FIG. 5) which is an example of the recording medium bundle. In addition, second binding teeth 72 are provided above the first binding teeth 71.

The first binding teeth 71 which serve as an example of first teeth and the second binding teeth 72 which serve as an example of second teeth are provided with an uneven portion.

A surface of the first binding teeth 71 positioned on the second binding teeth 72 side and a surface of the second binding teeth 72 positioned on the first binding teeth 71 side are provided with an uneven portion in which projecting portions and recessed portions are arranged alternately in the direction indicated by an arrow 4X in the drawing.

In other words, a surface of the first binding teeth 71 positioned on the second binding teeth 72 side and a surface of the second binding teeth 72 positioned on the first binding teeth 71 side are provided with an uneven portion in which projecting portions and recessed portions are arranged alternately in the longitudinal direction of the first binding teeth 71 and the second binding teeth 72.

In the present exemplary embodiment, when a binding process is to be performed by the first binding teeth 71 and the second binding teeth 72, the second binding teeth 72 are advanced toward the first binding teeth 71.

More specifically, in the present exemplary embodiment, when a binding process is to be performed, the second binding teeth 72 are lowered along a straight path (hereinafter referred to as a "straight path 4Y") indicated by an arrow 4Y in the drawing.

Then, in the present exemplary embodiment, the paper bundle T positioned between the first binding teeth 71 and the second binding teeth 72 is sandwiched between the first binding teeth 71 and the second binding teeth 72 to be pressed.

At this time, in the present exemplary embodiment, the projecting portions provided on the first binding teeth 71 and the recessed portions provided in the second binding teeth 72 face each other. At this time, in addition, the recessed portions provided in the first binding teeth 71 and the projecting portions provided on the second binding teeth 72 face each other.

The projecting portions provided on one side are inserted into the recessed portions provided on the other side. Consequently, a binding process is performed on the paper P with sheets of the paper P that constitute the paper bundle T pressure-bonded to each other. After that, in the present exemplary embodiment, the second binding teeth 72 are moved upward to be retracted from the first binding teeth 71.

While the projecting portions and the recessed portions are arranged alternately in the first binding teeth 71 and the second binding teeth 72 by way of example in the present exemplary embodiment, the projecting portions and the recessed portions may be disposed differently.

A binding process may be performed when the paper bundle T is pressed by the first binding teeth 71 and the second binding teeth 72, by cutting a part of the paper bundle T to form a reed-shaped piece, forming a through hole in the paper bundle T, and inserting the reed-shaped piece into the through hole, for example.

The binding process performed by the first binding teeth 71 and the second binding teeth 72 is not specifically limited.

As illustrated in FIG. 4, the second binding device 52 is provided with a moving mechanism 500 that serves as an example of a moving unit that moves the second binding teeth 72 toward the first binding teeth 71.

The moving mechanism 500 includes a bar-shaped screw member 510 that extends along the up-down direction in the drawing, and moves the second binding teeth 72 toward the first binding teeth 71 by rotating the screw member 510 in the circumferential direction. The screw member 510 is an example of a screw to be meshed with an interlocking portion interlocked with the second teeth.

The screw member 510 is made of metal. The screw member 510 is formed to be straight.

Projecting portions and groove portions in a spiral shape are formed on the outer peripheral surface of the screw member 510. In other words, male threads in which the projecting portions and the groove portions are arranged at constant intervals determined in advance in the axial direction of the screw member 510 are provided on the outer peripheral surface of the screw member 510. The projecting portions and the groove portions are disposed alternately in the axial direction of the screw member 510.

The screw member 510 according to the present exemplary embodiment is a screw that conforms to the JIS standard. The type of the screw member 510 is not specifically limited. For example, a screw member with trapezoidal threads may be used. The screw member 510 is not limited to being provided as an independent screw member, and may be integrated with a member with a different function.

The screw member 510 is disposed along the straight path 4Y along which the second binding teeth 72 are moved.

In the present exemplary embodiment, a screw with multiple threads is used as the screw member 510. More specifically, in the present exemplary embodiment, a screw with double threads is used as the screw member 510. In the present exemplary embodiment, the term "multiple threads" refers to threads in which two or more spiral threads provided in one pitch.

In the present exemplary embodiment, an interlocking portion 600 to be moved in conjunction with the second binding teeth 72 is provided. Further, the screw member 510 is meshed with the interlocking portion 600. In other words, the screw member 510 is connected to the interlocking portion 600.

More specifically, the interlocking portion 600 is provided with a female thread portion 610, and the screw member 510 which has male threads is meshed with a portion of the interlocking portion 600 provided with the female thread portion 610.

The moving mechanism 500 moves the second binding teeth 72 toward the first binding teeth 71 by rotating the screw member 510 meshed with the female thread portion 610 in the circumferential direction.

More specifically, in the present exemplary embodiment, when a drive motor M to be discussed later is rotated forward, the screw member 510 is rotated in one circumferential direction.

Consequently, the interlocking portion 600 and the second binding teeth 72 are lowered, and the second binding teeth 72 are moved toward the first binding teeth 71. Consequently, the binding process is performed.

In the present exemplary embodiment, when the screw member 510 is rotated in the circumferential direction, the interlocking portion 600 and the second binding teeth 72 are moved along the axial direction of the screw member 510.

In the present exemplary embodiment, when the binding process is finished, the drive motor M is rotated in reverse, and the screw member 510 is rotated in the reverse direction.

Consequently, the interlocking portion 600 and the second binding teeth 72 are elevated. When the second binding teeth 72 are elevated, the second binding teeth 72 are retracted from the first binding teeth 71.

As illustrated in FIG. 5, the moving mechanism 500 is provided with a drive motor M that serves as an example of a drive source, besides the screw member 510. The drive motor M is not specifically limited, and may be one known in the art. The drive motor M may be a direct current (DC) motor such as a brushless DC motor and a brushed DC motor, a stepping motor, etc., for example.

In the present exemplary embodiment, a drive gear (not illustrated) connected to an output shaft of the drive motor M and disposed coaxially with the output shaft is provided below the drive motor M. A rotary gear (not illustrated) meshed with the drive gear to be rotated is provided. In the present exemplary embodiment, further, a large-diameter gear 520 meshed with the rotary gear to receive a drive force from the rotary gear is provided as illustrated in FIG. 4.

The large-diameter gear 520 which serves as an example of a rotary body is disposed coaxially with the screw member 510.

In the present exemplary embodiment, in addition, a lower end portion of the screw member 510 is fixed to the large-diameter gear 520. In the present exemplary embodiment, further, the outside diameter of the large-diameter gear 520 is larger than the outside diameter of the screw member 510.

In the present exemplary embodiment, the large-diameter gear 520 is rotated by the drive motor M, and accordingly the screw member 510 is rotated in the circumferential direction.

In the present exemplary embodiment, the large-diameter gear 520 receives a drive force to be transferred to the screw member 510. Then, the drive force is transferred from the large-diameter gear 520 to the screw member 510.

Consequently, the screw member 510 is rotated about the axis. When the screw member 510 is rotated about the axis, the second binding teeth 72 are advanced and retracted with respect to the first binding teeth 71.

In the present exemplary embodiment, a screw moving unit is constituted from the screw member 510 and the large-diameter gear 520.

Other examples of the mechanism that moves the second binding teeth 72 include a cam mechanism and a jack mechanism.

In the case where a cam mechanism or a jack mechanism is used, it is conceivable to provide the cam mechanism or the jack mechanism at a location indicated by symbol 4Z in FIG. 4 (above the second binding device 52), for example.

In this aspect, the cam mechanism or the jack mechanism presses the interlocking portion 600 from above to move the second binding teeth 72.

In this case, it is difficult to increase the amount of separation between the first binding teeth 71 and the second binding teeth 72 while suppressing an increase in the size of the second binding device 52.

In the present exemplary embodiment, the space between the first binding teeth 71 and the second binding teeth 72 serves as a reception portion that receives the paper bundle T. In the case where the cam mechanism or the jack mechanism is used, it is difficult to increase the size of the reception portion while suppressing an increase in the size of the second binding device 52.

In the case where the cam mechanism or the jack mechanism is used, the amount of advancement and retraction of the second binding teeth 72 is increased by increasing the size of the cam mechanism or the jack mechanism, which increases the size of the reception portion. In this case, however, the size of the second binding device 52 is increased.

If the size of the reception portion is reduced, meanwhile, an increase in the size of the second binding device 52 is suppressed. In this case, however, the maximum number of sheets of the paper P that may be subjected to a binding process is reduced.

In contrast, when the screw member 510 is used as in the present exemplary embodiment, an increase in the size of the second binding device 52 is suppressed, and the size of the reception portion is further increased.

In the present exemplary embodiment, in particular, components of a part of the moving mechanism 500, such as the drive motor M and the screw member 510, are provided at a side of the straight path 4Y along which the second binding teeth 72 are moved, as illustrated in FIG. 5.

In this case, the size of the reception portion is secured while reducing the dimension of the second binding device 52 in the height direction.

In the present exemplary embodiment, as illustrated in FIG. 4, the large-diameter gear 520 is disposed so as to extend in a direction that intersects the straight path 4Y along which the second binding teeth 72 are moved. This also reduces the dimension of the second binding device 52 in the height direction.

In the present exemplary embodiment, the direction in which the straight path 4Y extends and the radial direction of the large-diameter gear 520 intersect (are orthogonal to) each other.

In this case, the dimension of the second binding device 52 in the height direction is reduced compared to the case where the large-diameter gear 520 is installed along the direction in which the straight path 4Y extends.

In the present exemplary embodiment, the end guides 64 illustrated in FIG. 3 are configured to allow passage of the second binding device 52.

More specifically, in the present exemplary embodiment, the maximum amount of separation between the first binding teeth 71 and the second binding teeth 72 is larger than the height of the end guides 64, which allows the end guides 64 to pass through the reception portion described above. Consequently, the second binding device 52 passes through the end guides 64.

As illustrated in FIG. 4, the interlocking portion 600 is provided with a load receiving member 620. In the present exemplary embodiment, the load receiving member 620 is provided with the female thread portion 610.

The load receiving member 620 which serves as an example of a load receiving portion contacts the screw member 510, and receives a load from the screw member 510.

The interlocking portion 600 is also provided with an upper support member 630 that supports the load receiving member 620 and the second binding teeth 72.

The interlocking portion 600 is also provided with two bar-like members 640 attached to the upper support member 630 to extend downward. The interlocking portion 600 is also provided with fixation members 650 that fix the respective bar-like members 640 to the upper support member 630.

In the present exemplary embodiment, a left bar-like member 640L positioned on the left side in the drawing and a right bar-like member 640R positioned on the right side in the drawing are provided as the bar-like members 640.

The left bar-like member 640L and the right bar-like member 640R are disposed so as to extend along the straight path 4Y.

The bar-like members 640 are used to guide the interlocking portion 600. The bar-like members 640 are also used to guide the second binding teeth 72.

In the present exemplary embodiment, the outside diameter of the bar-like members 640 is larger than the outside diameter of the screw member 510. More specifically, the outside diameter of each of the left bar-like member 640L and the right bar-like member 640R is larger than the outside diameter of the screw member 510.

In the present exemplary embodiment, the upper support member 630 and the bar-like members 640 are separate components, and the bar-like members 640 are attached to the upper support member 630.

This is not limiting, and the upper support member 630 and the bar-like members 640 may be integrated with each other to provide the upper support member 630 with the function of the bar-like members 640.

The fixation members 650 are constituted from nuts 652. Bolt portions 651 are provided at the distal end portion, which is positioned on the upper side in the drawing, of the bar-like members 640. The nuts 652 are fixed to the bolt portions 651.

In the present exemplary embodiment, bar-like member bodies 648 in a circular column shape are provided at a portion of the bar-like members 640 positioned on the lower side with respect to the upper support member 630.

In the present exemplary embodiment, through holes 633 (see FIG. 5) that serve as an example of a hole portion are formed in the upper support member 630.

In the present exemplary embodiment, the bar-like members 640 pass through the through holes 633. In the present exemplary embodiment, as illustrated in FIG. 5, the bolt portions 651 of the bar-like members 640 project above the upper support member 630.

In the present exemplary embodiment, as illustrated in FIG. 5, the nuts 652 are attached to the bolt portions 651 which project above the upper support member 630.

In the present exemplary embodiment, the upper support member 630 is sandwiched between the nuts 652 attached to the bolt portions 651 and the bar-like member bodies 648 of the bar-like members 640. Consequently, the bar-like members 640 are fixed to the upper support member 630.

In the present exemplary embodiment, as illustrated in FIG. 4, the second binding teeth 72 are fixed to the upper support member 630. More specifically, in the present exemplary embodiment, the second binding teeth 72 are fixed to one end portion 631, which is positioned on the front side in the drawing, of the upper support member 630.

More specifically, in the present exemplary embodiment, the second binding teeth 72 are fixed to the upper support member 630 by press fitting. The method of fixing the second binding teeth 72 is not limited to press fitting, and may be other methods such as bonding, welding, and fastening.

Further, a lower support member 700 that supports the first binding teeth 71 is provided below the interlocking portion 600. In other words, the lower support member 700 that supports the first binding teeth 71 is provided below the upper support member 630.

In the present exemplary embodiment, the first binding teeth 71 are fixed to the upper support member 700 by press fitting. As described above, the method of fixing the first binding teeth 71 is not limited to press fitting, and may be other methods such as bonding, welding, and fastening.

The lower support member 700 is provided with a teeth support portion 710 that extends in the width direction of the second binding device 52 and that supports the first binding teeth 71 from below.

The lower support member 700 is further provided with connection portions 720 connected to respective end portions of the teeth support portion 710 to extend from the end portions toward the rear of the second binding device 52.

In the present exemplary embodiment, the lower support member 700 is formed from a metal block, and the teeth support portion 710 and the connection portions 720 are integral with each other.

In the present exemplary embodiment, as illustrated in FIG. 5, guide portions 90 that guide the second binding teeth 72 are provided.

The guide portions 90 are provided on the lower support member 700. The guide portions 90 are disposed along the straight path 4Y along which the second binding teeth 72 are moved.

In the present exemplary embodiment, as described above, the bar-like members 640 are provided, and the guide portions 90 guide the bar-like members 640 to guide the second binding teeth 72.

More specifically, in the present exemplary embodiment, the lower support member 700 is provided with hole portions 91 that extend along the straight path 4Y.

The guide portions 90 according to the present exemplary embodiment are constituted from inner peripheral surfaces 91A of the hole portions 91.

In the present exemplary embodiment, the bar-like members 640 which serve as an example of a guided portion are guided using the inner peripheral surfaces 91A of the hole portions 91.

In the present exemplary embodiment, a plurality of guide portions 90 and a plurality of bar-like members 640, as a guided portion, are provided. Specifically, in the present exemplary embodiment, two guide portions 90 and two bar-like members 640 are provided.

In the present exemplary embodiment, as described above, two guided portions and two guide portions are provided. However, the number of the guided portions and the number of the guide portions installed are not limited thereto, and may be one or three or more.

The hole portions 91 are formed to have a circular cross section. In the present exemplary embodiment, the bar-like members 640 are constituted from a circular column member with a diameter of 10 mm or more, for example.

The cross-sectional shape of the hole portions 91 and the cross-sectional shape of the bar-like members 640 are not limited to a circular shape, and may be shapes other than a circular shape such as an elliptical shape and a polygonal shape. In the present exemplary embodiment, the bar-like members 640 in a circular column shape that constitute a part of the interlocking portion 600 (see FIG. 4) are inserted into the hole portions 91, and the bar-like members 640 are guided by the inner peripheral surfaces 91A of the hole portions 91.

In the present exemplary embodiment, the guide portions 90 are constituted from the hole portions 91 which are an example of holes provided in the lower support member 700. More specifically, the guide portions 90 are constituted from the inner surfaces of the hole portions 91 provided in the lower support member 700.

The guide portions 90 guide the outer surfaces of the bar-like members 640 using the inner surfaces of the hole portions 91.

The bar-like members 640 (see FIG. 4) which serve as an example of a guided portion or a bar-like portion extend along the up-down direction which corresponds to the direction of movement of the interlocking portion 600. In other words, the bar-like members 640 extend along a movement path of the interlocking portion 600.

The bar-like members 640 extend toward the downstream side in the direction of movement of the interlocking portion 600, starting from the location of connection with the upper support member 630.

In the present exemplary embodiment, the hole portions 91 (see FIG. 5), which function as a guide portion, provided in the lower support member 700 also extend along the direction of movement of the interlocking portion 600.

In FIGS. 4 and 5, the guide portion is constituted from the inner surfaces of holes, and the guided portion is constituted from bar-like portions that contact the inner surfaces of the holes. However, this is not limiting, and the guided portion may be constituted from the inner surfaces of holes, and the guide portion may be constituted from bar-like portions that contact the inner surfaces of the holes.

The hole portions 91 (see FIG. 5) provided in the lower support member 700 may be provided to penetrate the lower support member 700. This is not limiting, and the hole portions 91 provided in the lower support member 700 may be bottomed and may not penetrate the lower support member 700.

In the present exemplary embodiment, the area of contact between the guide portions 90 (see FIG. 5) and the bar-like members 640 which serve as a guided portion is increased as the second binding teeth 72 are moved toward the first binding teeth 71.

More specifically, in the present exemplary embodiment, the area of contact between the guide portions 90 and the bar-like members 640 is increased, with the amount of insertion of the bar-like members 640 into the hole portions 91 increased, as the second binding teeth 72 are moved toward the first binding teeth 71.

In other words, in the present exemplary embodiment, the area of a region in which the guide portions 90 and the bar-like members 640 overlap each other is increased as the second binding teeth 72 are moved toward the first binding teeth 71.

Figure 6:
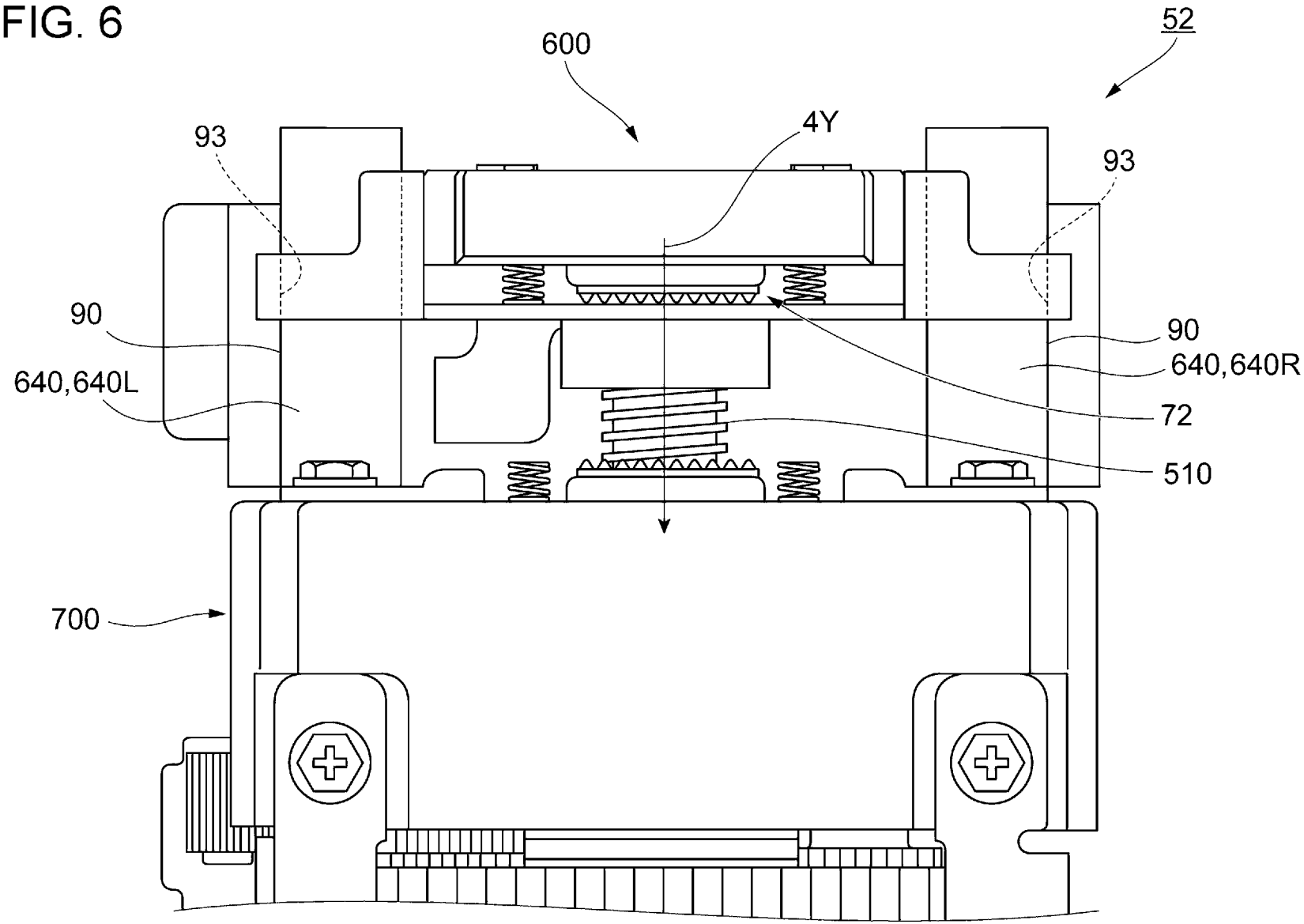
FIG. 6 illustrates another configuration example of the second binding device.

FIG. 6 illustrates another configuration example of the second binding device 52.

FIG. 6 illustrates a case where the guided portion is constituted from the inner surfaces of holes and the guide portion is constituted from bar-shaped portions that contact the inner surfaces of the holes.

In this configuration example, hole portions 93 that extend along the straight path 4Y are provided on the side of the interlocking portion 600 interlocked with the second binding teeth 72.

In this configuration example, in addition, bar-like members 640 inserted into the hole portions 93 and extending along the straight path 4Y are provided on the side of the lower support member 700. The bar-like members 640 are fixed to the lower support member 700.

In this configuration example, the outer peripheral surfaces of the bar-like members 640 constitute the guide portions 90, and the interlocking portion 600 is guided using the outer peripheral surfaces.

In this configuration example, the guided portion is constituted from the inner surfaces of the hole portions 93 that extend along the direction of movement of the interlocking portion 600. In this configuration example, in addition, the guide portion is constituted from the bar-like members 640 that extend along the direction of movement of the interlocking portion 600 to contact the inner surfaces of the hole portions 93.

In the present exemplary embodiment (in the exemplary embodiment illustrated in FIGS. 4 and 5), the screw member 510 is movable with respect to the interlocking portion 600 in a direction that intersects (is orthogonal to) the direction in which the screw member 510 extends.

Specifically, in the present exemplary embodiment, the screw member 510 is movable with respect to the interlocking portion 600 in a direction indicated by the arrow 4A in FIG. 4.

In other words, the screw member 510 is movable in the width direction of the second binding device 52.

In the present exemplary embodiment, the load receiving member 620 is movable in the direction indicated by the arrow 4A.

More specifically, in the present exemplary embodiment, the load receiving member 620 is movable relative to the upper support member 630, which renders the load receiving member 620 movable in the width direction of the second binding device 52.

In other words, in the present exemplary embodiment, the load receiving member 620 is movable with respect to the upper support member 630 and the bar-like members 640 which constitute a part of the interlocking portion 600.

When the load receiving member 620 is movable with respect to the upper support member 630 and the bar-like members 640 in this manner, the screw member 510 is movable with respect to the upper support member 630 and the bar-like members 640.

More specifically, the screw member 510 is movable with respect to the upper support member 630 and the bar-like members 640 in a direction that intersects (is orthogonal to) the direction in which the screw member 510 extends. In other words, the screw member 510 is movable in the radial direction of the screw member 510.

Figure 7:
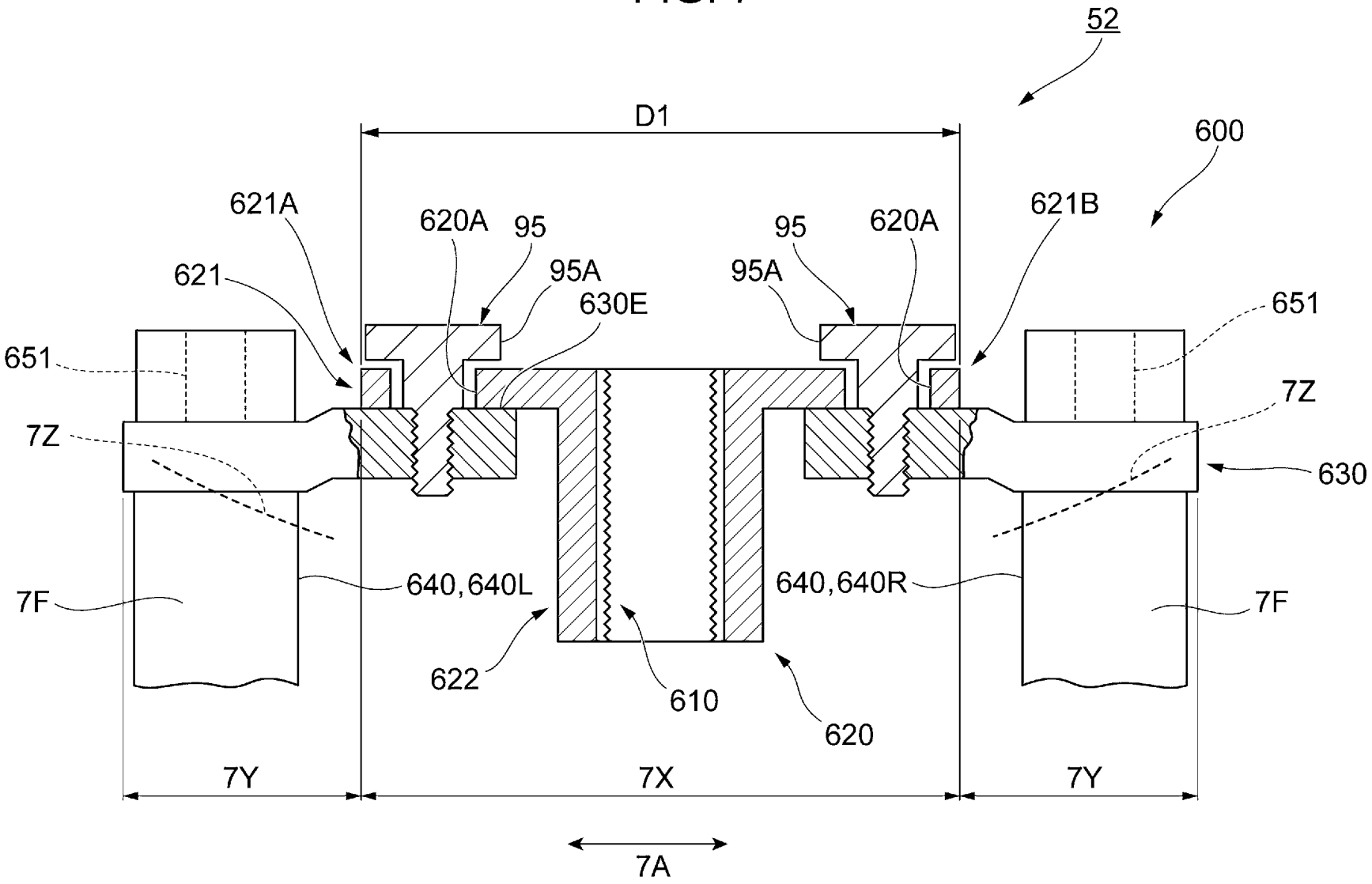
FIG. 7 is a sectional view of the second binding device taken along a line VII-VII in FIG. 4, illustrating an upper portion of the second binding device.

FIG. 7 is a sectional view of the second binding device 52 taken along a line VII-VII in FIG. 4, illustrating an upper portion of the second binding device 52.

In the present exemplary embodiment, as illustrated in FIG. 7, through holes 620A are formed in the load receiving member 620, and fixation screws 95 that are used to fix the load receiving member 620 to the upper support member 630 are inserted through the through holes 620A.

A gap is formed between the inner peripheral surfaces of the through holes 620A and the fixation screws 95. A threaded portion is not provided on the outer peripheral surface of a portion of the fixation screws 95 positioned in the through holes 620A.

The thickness of the load receiving member 620 is less than the separation distance between head portions 95A of the fixation screws 95 and an upper surface 630E of the upper support member 630.

Consequently, in the present exemplary embodiment, the load receiving member 620 is movable with respect to the upper support member 630 in a direction indicated by an arrow 7A in the drawing.

In this case, the screw member 510 (not illustrated in FIG. 7) is movable with respect to the upper support member 630 and the bar-like members 640. In other words, the screw member 510 is movable with respect to the interlocking portion 600 (see FIG. 4) in a direction that intersects the direction in which the screw member 510 extends.

A configuration in which the screw member 510 is not movable with respect to the interlocking portion 600, for example, and in which the screw member 510 is inclined with respect to the straight path 4Y (see FIG. 4), for example, is assumed.

In this case, when the second binding teeth 72 are advanced toward the first binding teeth 71, the second binding teeth 72 are moved toward a position that is different from the original position. In this case, the position of the second binding teeth 72 with respect to the first binding teeth 71 is displaced from the originally expected position.

If the screw member 510 is movable as in the present exemplary embodiment, on the contrary, the tilt of the screw member 510 with respect to the straight path 4Y is smaller, and the displacement of the second binding teeth 72 with respect to the first binding teeth 71 is smaller.

In the configuration in which the screw member 510 is not movable with respect to the interlocking portion 600 and the screw member 510 is inclined with respect to the straight path 4Y, binding may not be performed with the second binding teeth 72 stopped in the middle of the second binding teeth 72 being moved toward the first binding teeth 71.

In the present exemplary embodiment, portions indicated by symbol 7F in FIG. 7 serve as a guided portion to be guided by the guide portions 90 (see FIG. 5). In the present exemplary embodiment, the load receiving member 620 is movable with respect to the guided portion.

More specifically, the load receiving member 620 is movable with respect to the guided portion in a direction that intersects (is orthogonal to) the axial direction of the screw member 510 (not illustrated in FIG. 7).

The interlocking portion 600 is configured to include the load receiving member 620 which serves as an example of a load receiving portion that contacts the screw member 510 to receive a load from the screw member 510, and the bar-like members 640 which serve as an example of a guided portion to be guided by the guide portions 90.

In the present exemplary embodiment, the load receiving member 620 which serves as an example of the load receiving portion is movable with respect to the bar-like members 640.

As illustrated in FIG. 7, the load receiving member 620 has a T-shaped sectional surface.

More specifically, the load receiving member 620 includes a large-diameter portion 621 in a disk shape positioned on the upper side in the drawing, and a small-diameter portion 622 positioned below the large-diameter portion 621.

The large-diameter portion 621 and the small-diameter portion 622 are disposed coaxially with each other. The lower end portion of the large-diameter portion 621 and the upper end portion of the small-diameter portion 622 are connected to each other.

The female thread portion 610 is provided on the center axis of the load receiving member 620.

The female thread portion 610 is in a tubular shape. In the present exemplary embodiment, the screw member 510 (see FIG. 4) in a bar shape is inserted through the female thread portion 610. In other words, in the present exemplary embodiment, the female thread portion 610 and the screw member 510 are meshed with each other to be connected to each other.

In the present exemplary embodiment, a length L1 (see FIG. 5) of the second binding teeth 72 in the longitudinal direction is less than an outside diameter D1 (see FIG. 7) of the large-diameter portion 621.

In the present exemplary embodiment, in the case where positions in the radial direction of the large-diameter portion 621 are compared, the second binding teeth 72 (see FIG. 5) are positioned on the side of a second end 621B of the large-diameter portion 621 with respect to a first end 621A (see FIG. 7) thereof. In addition, the second binding teeth 72 are positioned on the side of the first end 621A of the large-diameter portion 621 with respect to the second end 621B thereof.

In other words, in the present exemplary embodiment, in the case where the second binding device 52 is seen from the front (in the case where the second binding device 52 is seen from the side on which the reception portion is provided), the second binding teeth 72 are positioned between the first end 621A and the second end 621B of the large-diameter portion 621.

In the present exemplary embodiment, the load receiving member 620 is pulled downward by the screw member 510, and accordingly a portion of the upper support member 630 indicated by symbol 7X in FIG. 7 is uniformly pressed from the upper side by the load receiving member 620.

In this case, the uniformly pressed portion of the upper support member 630 is moved downward while generally maintaining a shape in which the portion extends transversely and linearly.

On the other hand, side portions (portions indicated by symbol 7Y in FIG. 7) of the upper support member 630 positioned on both sides of the pressed portion tend to be inclined with respect to the horizontal direction as indicated by symbol 7Z.

In this case, the second binding teeth 72 are easily distorted in a configuration in which the dimension of the second binding teeth 72 in the longitudinal direction is large and a part of the second binding teeth 72 reaches the side portions (portions indicated by symbol 7Y) described above.

In the present exemplary embodiment, the second binding teeth 72 are movable with respect to the guide portions 90 (see FIG. 5) in a direction that intersects the direction in which the guide portions 90 extend.

More specifically, in the present exemplary embodiment, the second binding teeth 72 are movable in a direction that intersects the direction indicated by an arrow 5X (see FIG. 5) in which the inner peripheral surfaces 91A of the hole portions 91 extend.

For an additional description, in the present exemplary embodiment, the second binding teeth 72 are movable in a direction that intersects the direction of advancement and retraction of the second binding teeth 72.

In the present exemplary embodiment, the upper support member 630 is movable in the direction indicated by an arrow 5Y in FIG. 5.

More specifically, in the present exemplary embodiment, the upper support member 630 is movable with respect to the bar-like members 640, and the upper support member 630 is movable in the direction indicated by the arrow 5Y. In other words, in the present exemplary embodiment, the upper support member 630 is movable along the longitudinal direction of the second binding teeth 72.

In the present exemplary embodiment, the second binding teeth 72 are moved in the longitudinal direction by moving the upper support member 630 with respect to the bar-like members 640.

For an additional description, in the present exemplary embodiment, when the upper support member 630 is moved with respect to the bar-like members 640, the second binding teeth 72 are moved in a direction that intersects the direction (direction indicated by the arrow 5X in the drawing) in which the guide portions 90 extend.

More specifically, in the present exemplary embodiment, as illustrated in FIG. 5, the bolt portions 651 are provided at the upper end portions of the bar-like members 640.

In the present exemplary embodiment, further, the through holes 633 through which the bolt portions 651 are inserted are formed in the upper support member 630. The through holes 633 are so-called long holes, and are formed so as to extend along the longitudinal direction of the second binding teeth 72.

Consequently, in the present exemplary embodiment, the upper support member 630 is movable with respect to the bar-like members 640, and the second binding teeth 72 are movable in a direction that intersects the direction in which the bar-like members 640 extend. In other words, the second binding teeth 72 are movable in a direction that intersects the direction in which the guide portions 90 extend.

More specifically, the second binding teeth 72 are movable in the direction indicated by the arrow 5Y in FIG. 5.

In the present exemplary embodiment, the upper support member 630 is moved in the longitudinal direction of the second binding teeth 72 after canceling fixation of the bar-like members 640 to the upper support member 630 by the bolt portions 651 and the nuts 652.

Consequently, the positional relationship between the first binding teeth 71 and the second binding teeth 72 is changed. For an additional description, the position of the second binding teeth 72 relative to the first binding teeth 71 is adjusted.

In the present exemplary embodiment, when adjustment of the position of the second binding teeth 72 is finished, the nuts 652 are tightened to the bolt portions 651, and the bar-like members 640 are fixed to the upper support member 630.

In the present exemplary embodiment, the upper support member 630 is moved along the longitudinal direction of the second binding teeth 72. However, this is not limiting, and the upper support member 630 may be moved in both the longitudinal direction of the second binding teeth 72 and a direction that is orthogonal to the longitudinal direction.

In order to render the upper support member 630 movable in both the longitudinal direction and a direction that is orthogonal thereto, for example, the through holes 633 described above formed in the upper support member 630 are formed as round holes with a diameter that is larger than the outside diameter of the bolt portions 651, for example.

Consequently, the upper support member 630 is movable in both the longitudinal direction and a direction that is orthogonal thereto.

Further, in the present exemplary embodiment, as illustrated in FIG. 5, the drive motor M is located between one end 511 and the other end 512 of the screw member 510 in the axial direction. In other words, in the present exemplary embodiment, the drive motor M is positioned at a side of the screw member 510.

Consequently, in the present exemplary embodiment, the size of the second binding device 52 is reduced in the direction in which the screw member 510 extends, or in other words in the direction of advancement and retraction of the second binding teeth 72.

When the drive motor M is located at a location indicated by symbol 5S in FIG. 5, for example, the size of the second binding device 52 tends to be increased.

In the present exemplary embodiment, all or the major portion of the drive motor M is located between the one end 511 and the other end 512 of the screw member 510 in the axial direction.

This is not limiting, and at least a part of the drive motor M may be positioned on the side of the other end 512 with respect to the one end 511 in the axial direction of the screw member 510 and positioned on the side of the one end 511 with respect to the other end 512.

Figure 8:
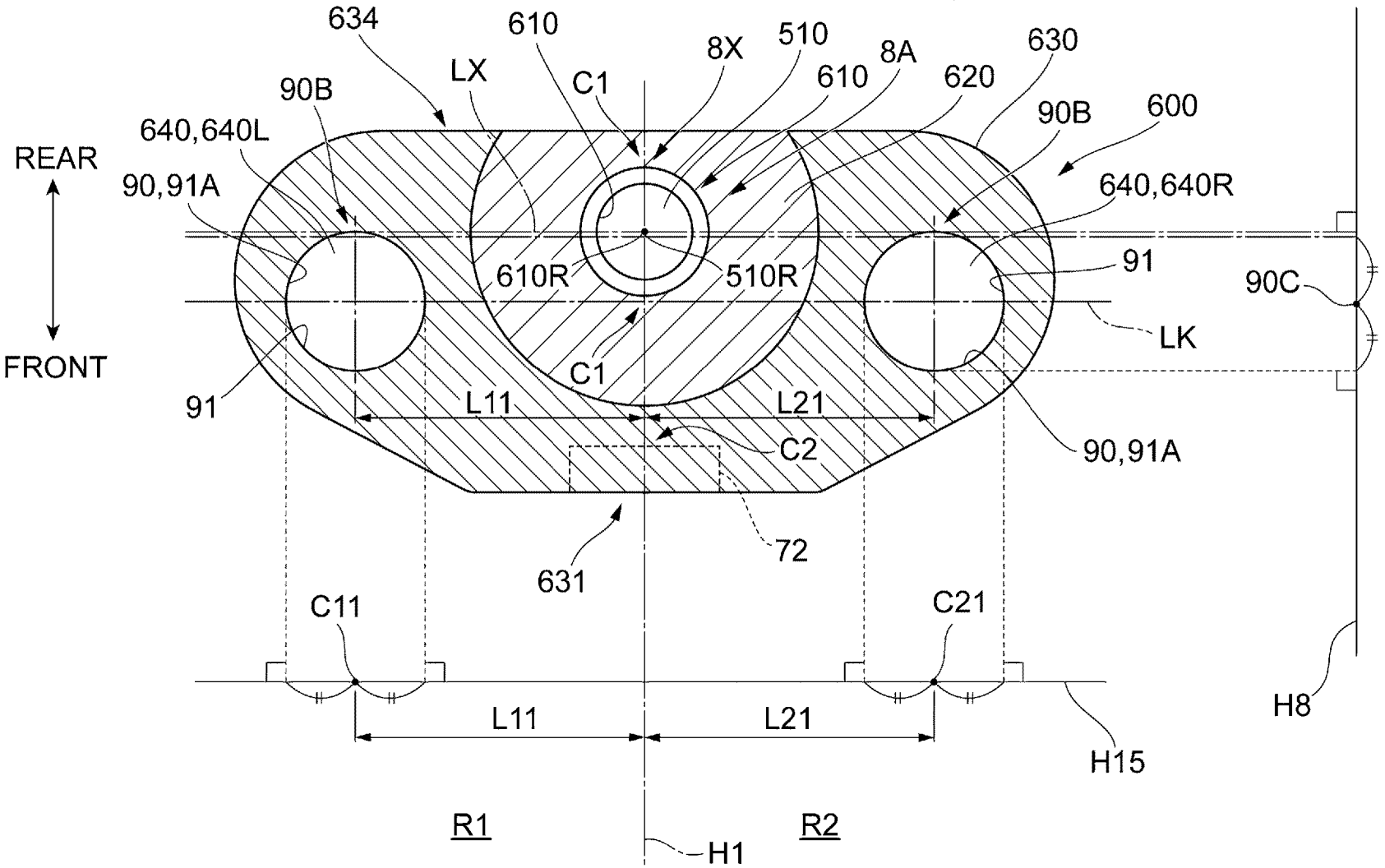
FIG. 8 illustrates a sectional surface of the second binding device taken along a line VIII-VIII in FIG. 5.

FIG. 8 illustrates a sectional surface of the second binding device 52 taken along a line VIII-VIII in FIG. 5.

The moving mechanism 500 (see FIG. 4) according to the present exemplary embodiment applies a load to a specific location of the interlocking portion 600 to move the second binding teeth 72 toward the first binding teeth 71.

More specifically, the moving mechanism 500 applies a load to a specific location (hereinafter referred to as a "load application location 8A") of the interlocking portion 600 indicated by symbol 8A (see FIG. 8) to move the second binding teeth 72 toward the first binding teeth 71.

More specifically, in the present exemplary embodiment, the load application location 8A is a location at which the female thread portion 610 is provided. In the present exemplary embodiment, the second binding teeth 72 are moved toward the first binding teeth 71 by moving the interlocking portion 600 by applying a load to the location at which the female thread portion 610 is provided.

In the present exemplary embodiment, the guide portions 90 (inner peripheral surfaces 91A of the hole portions 91) are positioned on the side closer to the second binding teeth 72 than the load application location 8A.

The guide portions 90 being positioned on the side closer to the second binding teeth 72 does not mean that all portions of the guide portions 90 are positioned on the side closer to the second binding teeth 72 than the load application location 8A.

In the present exemplary embodiment, rear-side portions 90B of the guide portions 90 positioned on the rearmost side are positioned closer to the second binding teeth 72 than a rear-side portion 8X of the load application location 8A positioned on the rearmost side.

In the case where the rear-side portions 90B of the guide portions 90 are positioned on the side closer to the second binding teeth 72 than the rear-side portion 8X of the load application location 8A when such portions positioned on the rearmost side are compared with each other, it is considered that the guide portions 90 are positioned on the side closer to the second binding teeth 72 than the load application location 8A.

The guide portions 90 guide the second binding teeth 72 by guiding a portion of the interlocking portion 600, which is interlocked with the second binding teeth 72, positioned on the side closer to the second binding teeth 72 than the load application location 8A.

More specifically, the guide portions 90 guide the second binding teeth 72 by guiding the bar-like members 640 which are positioned on the side closer to the second binding teeth 72 than the load application location 8A.

In the present exemplary embodiment, in the case where a virtual plane H1 that passes through the load application location 8A and the second binding teeth 72 and that extends along the straight path 4Y (see FIG. 5) is assumed, the guide portions 90 are respectively provided in two regions R1 and R2 that face each other with the plane H1 interposed therebetween.

More specifically, in the present exemplary embodiment, in the case where a virtual plane H1 that passes through a center portion C1 of the load application location 8A and a center portion C2 of the second binding teeth 72 in the longitudinal direction and that extends along the straight path 4Y is assumed, the guide portions 90 are respectively provided in two regions R1 and R2 that face each other with the plane H1 interposed therebetween.

In other words, in the present exemplary embodiment, in the case where a virtual plane H1 that passes through an axial center 510R of the screw member 510 and the center portion C2 of the second binding teeth 72 in the longitudinal direction and that extends along the straight path 4Y is assumed, the guide portions 90 are respectively provided in two regions R1 and R2 that face each other with the plane H1 interposed therebetween.

In the present exemplary embodiment, further, the guide portions 90 respectively provided in the two regions R1 and R2 are disposed on the side closer to the second binding teeth 72 than the load application location 8A.

In the present exemplary embodiment, when the second binding teeth 72 are pressed against the paper bundle T, the second binding teeth 72 are pressed upward by a reaction, and the upper support member 630 is moved upward on the side of the one end portion 631.

In this case, if the guide portions 90 are positioned on the side closer to the second binding teeth 72 than the load application location 8A as in the present exemplary embodiment, the one end portion 631 of the upper support member 630 is not likely to be moved upward.

In the present exemplary embodiment, in the case where a virtual line LX that passes through an axial center 610R of the female thread portion 610 and that extends along the longitudinal direction of the second binding teeth 72 is assumed, the guide portions 90 are positioned at a location off the virtual line LX.

More specifically, the guide portions 90 are positioned on the side closer to the second binding teeth 72 than the virtual line LX.

FIG. 8 illustrates a sectional surface of the second binding device 52 as seen from above. In the case where the second binding device 52 is seen from above, the guide portions 90 are positioned on the side closer to the second binding teeth 72 than the virtual line LX.

The language "the guide portions 90 are positioned on the side closer to the second binding teeth 72 than the virtual line LX" refers to a state in which a center portion 90C of the guide portions 90 obtained by projecting the guide portions 90 to a plane H8 is positioned on the second binding teeth 72 side with respect to the virtual line LX projected to the plane H8.

The plane H8 is a plane that is orthogonal to the longitudinal direction of the second binding teeth 72. In the present exemplary embodiment, in the case where the guide portions 90 and the virtual line LX are projected to the plane H8 (in the case where the guide portions 90 and the virtual line LX are projected in a direction that is orthogonal to the plane H8), the center portion 90C of the guide portions 90 (center portion in the direction in which the plane H8 extends) is positioned on the second binding teeth 72 side with respect to the virtual line LX.

The guide portions 90 being positioned on the side closer to the second binding teeth 72 than the virtual line LX is not limited to a state in which all portions of the guide portions 90 are positioned on the side closer to the second binding teeth 72 than the virtual line LX.

The guide portions 90 are considered to be positioned on the side closer to the second binding teeth 72 than the virtual line LX when the center portion 90C of the guide portions 90 is positioned on the second binding teeth 72 side with respect to the virtual line LX as described above.

In this case, the one end portion 631 of the upper support member 630 is not likely to be moved upward compared to the case where the guide portions 90 are positioned on the virtual line LX.

In other words, the one end portion 631 of the upper support member 630 is not likely to be moved upward compared to the case where the position of the virtual line LX and the position of the center portion 90C of the guide portions 90 are aligned with each other.

In this case, the second binding teeth 72 are not likely to escape upward, and a large load acts on the paper bundle T, when a binding process is performed.

In the present exemplary embodiment, the guide portions 90 respectively provided in the two regions R1 and R2 are disposed on a common line LK that extends along the longitudinal direction of the second binding teeth 72.

For an additional description, the guide portions 90 respectively provided in the two regions R1 and R2 are disposed on the line LK which extends along the longitudinal direction of the second binding teeth 72 and which passes through a location other than the axial center 610R of the female thread portion 610.

The language "the guide portions 90 are disposed on the line LK" refers to a state in which, in the case where the guide portions 90 and the virtual line LX are projected to the plane H8 (in the case where the guide portions 90 and the virtual line LX are projected in a direction that is orthogonal to the plane H8), the position of the center portion 90C of the guide portions 90 (center portion in the direction in which the plane H8 extends) and the position of the line LK coincide with each other.

In the present exemplary embodiment, further, a distance L11 between the guide portion 90 provided in one region R1, of the two regions R1 and R2, and the plane H1 and a distance L21 between the guide portion 90 provided in the other region R2 and the plane H1 are equal to each other.

For an additional description, in the present exemplary embodiment, the distance L11 between the guide portion 90, which is one of the two guide portions 90 disposed on the common line LK, and the plane H1 and the distance L21 between the other guide portion 90 and the plane H1 are equal to each other.

More specifically, a case where the one guide portion 90 and the other guide portion 90 are projected to a plane H15 that extends along the longitudinal direction of the second binding teeth 72 (case where the one guide portion 90 and the other guide portion 90 are projected in a direction that is orthogonal to the plane H15) is assumed.

In this case, in the present exemplary embodiment, the distance L11 between a center portion C11 (center portion in the direction in which the plane H15 extends) of the one guide portion 90 and the plane H1 and the distance L21 between a center portion C21 (center portion in the direction in which the plane H15 extends) of the other guide portion 90 and the plane H1 are equal to each other.

In the present exemplary embodiment, the female thread portion 610, which is a contact portion of the interlocking portion 600 that contacts the screw member 510, is positioned on the side of the right bar-like member 640R, which is an example of a second guided portion and is on the right side in the drawing, with respect to the left bar-like member 640L, which is an example of a first guided portion and is on the left side in the drawing.

The female thread portion 610 is positioned on the side of the left bar-like member 640L, which is on the left side in the drawing, with respect to the right bar-like member 640R, which is on the right side in the drawing.

In the present exemplary embodiment, the interlocking portion 600 is provided with the left bar-like member 640L and the right bar-like member 640R which are guided by the guide portions 90.

In the present exemplary embodiment, the female thread portion 610, which is an example of a contact portion, is positioned on the right bar-like member 640R side with respect to the left bar-like member 640L and on the left bar-like member 640L side with respect to the right bar-like member 640R.

In the present exemplary embodiment, the female thread portion 610 may be grasped as a load receiving portion that receives a load from the screw member 510. In the present exemplary embodiment, the load receiving portion is positioned on the right bar-like member 640R side with respect to the left bar-like member 640L, and positioned on the left bar-like member 640L side with respect to the right bar-like member 640R.

More specifically, a case where the left bar-like member 640L, the right bar-like member 640R, and the female thread portion 610 are projected to the plane H15 is assumed.

In this case, the female thread portion 610 is positioned on the right bar-like member 640R side with respect to the left bar-like member 640L, and positioned on the left bar-like member 640L side with respect to the right bar-like member 640R, on the plane H15.

In the present exemplary embodiment, the second binding teeth 72 are moved toward the first binding teeth 71 with a load applied to the load receiving member 620 of the interlocking portion 600 (see FIG. 8).

More specifically, the second binding teeth 72 are moved toward the first binding teeth 71 with a load applied to the female thread portion 610 provided on the load receiving member 620.

In the present exemplary embodiment, the first binding teeth 71 and the second binding teeth 72 are considered to be also positioned on the right bar-like member 640R side with respect to the left bar-like member 640L, and positioned on the left bar-like member 640L side with respect to the right bar-like member 640R.

Figure 9:
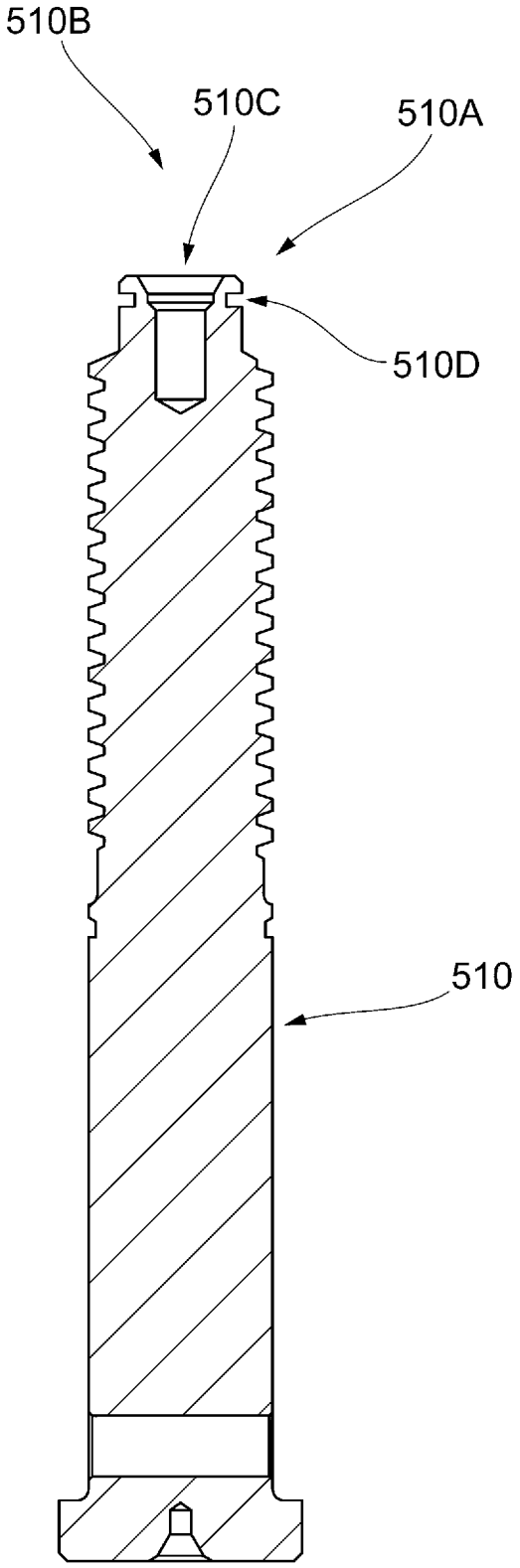
FIG. 9 is a vertical sectional view of a screw member.

FIG. 9 is a vertical sectional view of the screw member 510.

In the present exemplary embodiment, a regulation member that regulates movement of the interlocking portion 600 (see FIG. 4) is attachable to the screw member 510.

Specifically, an attached portion 510B is provided at one end portion 510A of the screw member 510. The regulation member is attachable to the attached portion 510B.

Specifically, a recessed portion 510C with a circular cross section is provided in an end surface of the screw member 510 positioned at the one end portion 510A to be recessed toward the inside of the screw member 510. Female threads are formed on the inner surface of the recessed portion 510C. In the present exemplary embodiment, a regulation member 980 (see FIG. 4) with male threads is attached to the portion with the female threads.

In the present exemplary embodiment, when the screw member 510 is rotated more than necessary and the interlocking portion 600 reaches the one end portion 510A (see FIG. 9) of the screw member 510, movement of the interlocking portion 600 is regulated with the interlocking portion 600 abutting against the regulation member 980.

In the present exemplary embodiment, in addition, a groove 510D that extends along the circumferential direction of the screw member 510 is formed at the one end portion 510A of the screw member 510 and in the outer peripheral surface thereof.

In the present exemplary embodiment, a retainer (not illustrated) with an E-shaped or C-shaped cross section, for example, may be mounted in the groove 510D. In the present exemplary embodiment, movement of the interlocking portion 600 may also be regulated by the retainer.

Figure 10:
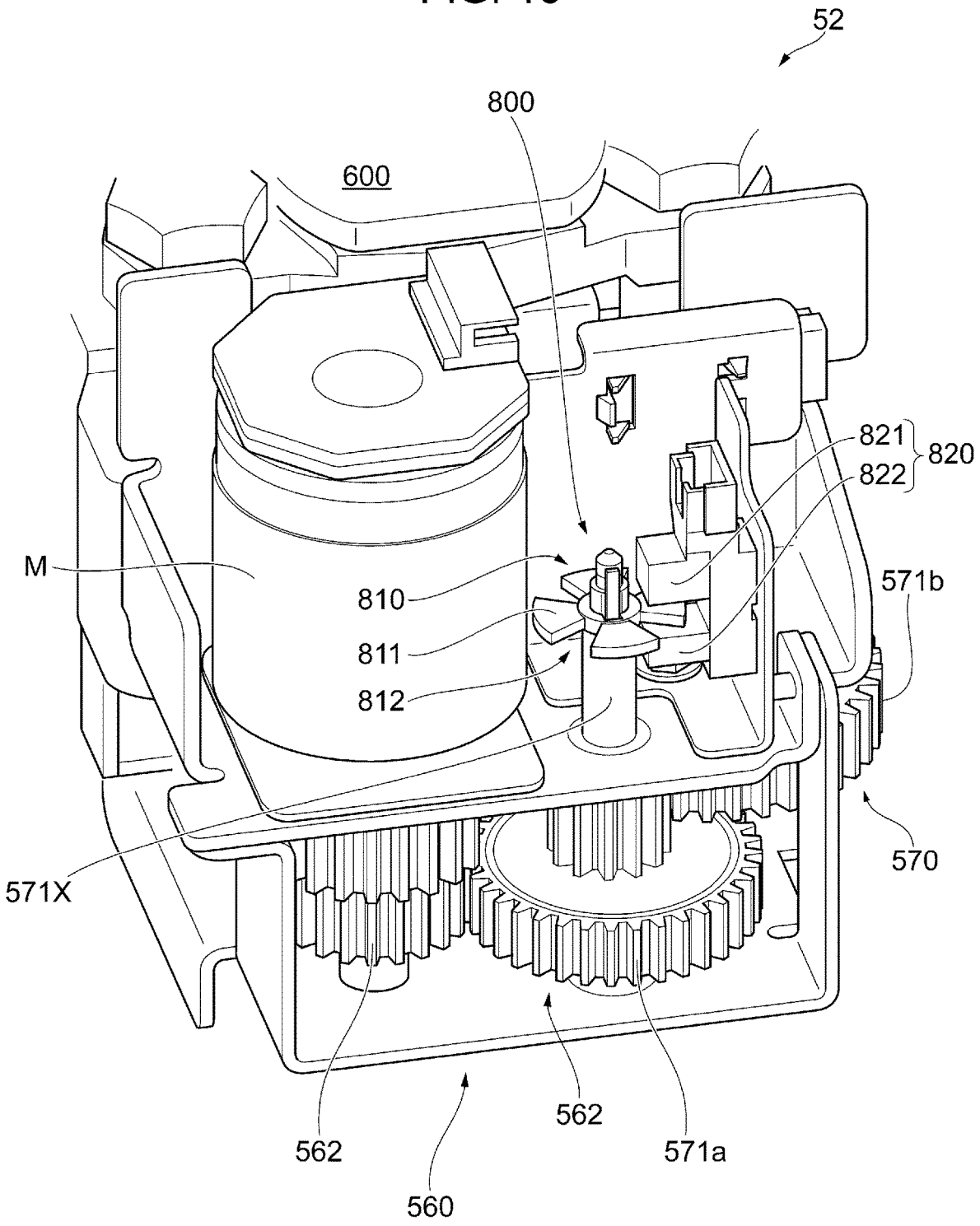
FIG. 10 illustrates the state of the second binding device on the back surface side.

FIG. 10 illustrates the state of the second binding device 52 on the back surface side.

Figure 11:
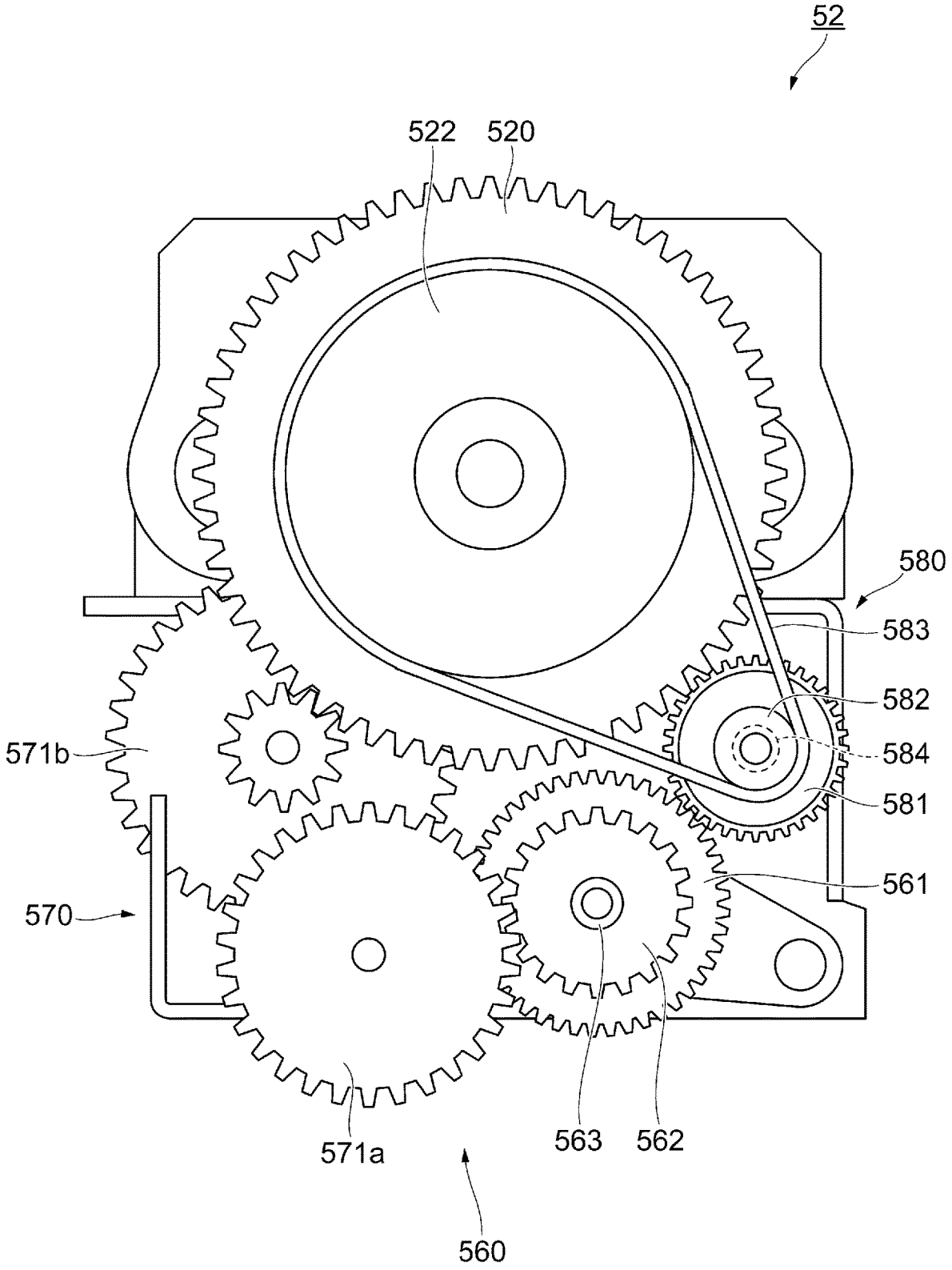
FIG. 11 illustrates the second binding device as seen from below.

FIG. 11 illustrates the second binding device 52 as seen from below. In FIG. 11, a housing that covers members of a transfer portion 560 is not illustrated.

In the present exemplary embodiment, the drive motor M is provided on the side of the back surface of the second binding device 52. The transfer portion 560 that transfers a drive force from the drive motor M to the large-diameter gear 520 is provided below the drive motor M.

The large-diameter gear 520 according to the present exemplary embodiment is provided with a pulley portion 522 provided on one side (lower side) along the axial direction to be rotated upon receiving a drive force from the transfer portion 560.

The transfer portion 560 includes a drive gear 561 and a switching gear 562 disposed below the drive motor M coaxially with the output shaft of the drive motor M to be rotated upon receiving a drive force from the drive motor M.

The transfer portion 560 also includes an electromagnetic clutch 563 that serves as an example of a switching unit that switches the switching gear 562 between a state in which the output shaft of the drive motor M and a rotary shaft of the switching gear 562 are engaged with each other and a state in which the output shaft of the drive motor M and the rotary shaft of the switching gear 562 are disengaged from each other. The switching of the state of engagement by the electromagnetic clutch 563 is made on the basis of control performed by the information processing section 100, as discussed in detail later.

The transfer portion 560 further includes a first transfer portion 570 that serves as an example of a first transfer unit that transfers a drive force from the drive motor M to the large-diameter gear 520, and a second transfer portion 580 that serves as an example of a second transfer unit, the first transfer portion 570 and the second transfer portion 580 being provided on the side of the back surface of the second binding device 52.

The first transfer portion 570 includes rotary gears 571*a* and 571*b* provided to be rotatable. In the following description, the rotary gear 571*a* and the rotary gear 571*b* will be simply indicated as "rotary gears 571" in the case where the rotary gears 571*a* and 571*b* are not differentiated from each other.

The rotary gears 571 of the first transfer portion 570 receive a rotational drive force from the switching gear 562, and transfer the rotational drive force to the large-diameter gear 520. For an additional description, the rotary gear 571*a* of the first transfer portion 570 receives a rotational drive force from the switching gear 562, and transfers the rotational drive force to the rotary gear 571*b*. Then, the rotary gear 571*b* transfers the rotational drive force received from the rotary gear 571*a* to the large-diameter gear 520.

In the present exemplary embodiment, the rotary gear 571 of the first transfer portion 570 transfers a rotational drive force to the large-diameter gear 520 in the case where the output shaft of the drive motor M and the rotary shaft of the switching gear 562 are engaged with each other by the electromagnetic clutch 563.

In this example, the rotary gears 571 are as an example of a first gear unit.

The second transfer portion 580 includes a rotary gear 581 provided to be rotatable. The second transfer portion 580 also includes a pulley 582 provided integrally on one side (lower side) of the rotary gear 581 in the axial direction. The pulley 582 is rotated in conjunction with rotation of the rotary gear 581. The second transfer portion 580 further includes a belt member 583 wound between the pulley 582 and the pulley portion 522 of the large-diameter gear 520 to be circulated in conjunction with rotation of the pulley 582. Furthermore, the second transfer portion 580 includes a torque limiter 584 provided between the rotary gear 581 and the pulley 582 to cancel transfer of a drive force between the rotary gear 581 and the pulley 582 in the case where torque determined in advance is applied.

The rotary gear 581, the pulley 582, and the belt member 583 of the second transfer portion 580 receive a rotational drive force from the drive gear 561, and transfer the rotational drive force to the large-diameter gear 520. For an additional description, when the rotary gear 581 of the second transfer portion 580 is rotated upon receiving a rotational drive force from the drive gear 561, the pulley 582 is rotated in conjunction with the rotary gear 581. Then, the belt member 583 is circulated through rotation of the pulley 582, and transfers a rotational drive force to the large-diameter gear 520 via the pulley portion 522.

In the present exemplary embodiment, the second transfer portion 580 transfers a rotational drive force to the large-diameter gear 520 as discussed above in the case where the output shaft of the drive motor M and the rotary shaft of the switching gear 562 are disengaged from each other by the electromagnetic clutch 563.

In this example, the rotary gear 581, the pulley 582, and the belt member 583 are an example of a second gear unit.

The torque limiter 584 of the second transfer portion 580 cancels transfer of a rotational drive force between the rotary gear 581 and the pulley 582 in the case where the output shaft of the drive motor M and the rotary shaft of the switching gear 562 are engaged with each other by the electromagnetic clutch 563. In other words, the torque limiter 584 of the second transfer portion 580 cancels transfer of a rotational drive force between the rotary gear 581 and the pulley 582 in the case where a rotational drive force from the drive motor M is transferred to the large-diameter gear 520 by the first transfer portion 570.

In this case, the rotary gear 581 having received a rotational drive force from the drive motor M idles, rather than transferring the rotational drive force to the pulley 582. Meanwhile, the belt member 583 and the pulley 582 having received a rotational drive force from the large-diameter gear 520 rotating idles, rather than transferring the rotational drive force to the rotary gear 581.

In the present exemplary embodiment, the drive force transferred from the drive motor M to the large-diameter gear 520 via the transfer portion 560 (the first transfer portion 570 and the second transfer portion 580) is further transferred to the second binding teeth 72.

For an additional description, the drive force transferred from the drive motor M to the large-diameter gear 520 via the transfer portion 560 is transferred from the large-diameter gear 520 to the second binding teeth 72 via the screw member 510 and the interlocking portion 600.

Consequently, the second binding teeth 72 are moved toward the first binding teeth 71, and the second binding teeth 72 are retracted from the first binding teeth 71.

In the transfer portion 560 according to the present exemplary embodiment, the gear ratio of the first transfer portion 570 with the rotary gear 571 is higher than the gear ratio of the second transfer portion 580 with the rotary gear 581, the pulley 582, and the belt member 583. In other words, in the transfer portion 560 according to the present exemplary embodiment, the gear ratio of the second transfer portion 580 is lower than the gear ratio of the first transfer portion 570. The gear ratio of the first transfer portion 570 or the second transfer portion 580 is the number of revolutions of the drive motor M required for the first transfer portion 570 or the second transfer portion 580 to cause the large-diameter gear 520 to make one revolution. The gear ratio of the first transfer portion 570 may be about five to ten times the gear ratio of the second transfer portion 580, for example, although this is not particularly limiting. The gear ratio of the first transfer portion 570 may be 1:91.7, for example, and the gear ratio of the second transfer portion 580 may be 1:11.2, for example.

In the present exemplary embodiment, in the case where the rotational speed of the drive motor M is not varied, the rotational speed of the large-diameter gear 520 for the case where the large-diameter gear 520 is rotated by the first transfer portion 570 is lower than the rotational speed of the large-diameter gear 520 for the case where the large-diameter gear 520 is rotated by the second transfer portion 580.

In other words, the rotational speed of the large-diameter gear 520 for the case where the large-diameter gear 520 is rotated by the second transfer portion 580 is higher than the rotational speed of the large-diameter gear 520 for the case where the large-diameter gear 520 is rotated by the first transfer portion 570.

The moving speed of the second binding teeth 72 for the case where the large-diameter gear 520 is rotated by the second transfer portion 580 is higher than the moving speed of the second binding teeth 72 for the case where the large-diameter gear 520 is rotated by the first transfer portion 570. In the following description, the moving speed of the second binding teeth 72 moved by the first transfer portion 570 will occasionally be referred to as a first moving speed V1, and the moving speed of the second binding teeth 72 moved by the second transfer portion 580 will occasionally be referred to as a second moving speed V2. In this example, the second moving speed V2 is higher than the first moving speed V1 (V1<V2).

Torque that acts on the large-diameter gear 520 in the case where the large-diameter gear 520 is rotated by the first transfer portion 570 is larger than torque that acts on the large-diameter gear 520 in the case where the large-diameter gear 520 is rotated by the second transfer portion 580.

Consequently, a large load may be applied to a paper bundle positioned between the first binding teeth 71 and the second binding teeth 72 in the case where the large-diameter gear 520 is rotated by the first transfer portion 520 compared to the case where the large-diameter gear 520 is rotated by the second transfer portion 580.

In the present exemplary embodiment, a position detection sensor 800 that functions as an example of a position detection section that detects the position of the second binding teeth 72 is provided on the side of the back surface of the second binding device 52.

The position detection sensor 800 detects the position of the second binding teeth 72 by acquiring information on the amount of movement of an interlocking portion interlocked with movement of the second binding teeth 72.

Specifically, the position detection sensor 800 detects the position of the second binding teeth 72 by acquiring information on the amount of rotation of a rotary portion that is rotated in conjunction with movement of the second binding teeth 72.

The position detection sensor 800 is constituted from a so-called rotary encoder. The position detection sensor 800 detects the position of the second binding teeth 72 using a rotary body 810 and a transmission sensor 820 that functions as a detection section that detects the amount of rotation of the rotary body 810.

The rotary body 810 is disposed coaxially with the rotary gears 571 of the first transfer portion 570, and rotated in conjunction with rotation of the rotary gears 571.

More specifically, the rotary body 810 is disposed coaxially with a part of the rotary gears 571 (the rotary gear 571*a* in this example), and rotated in conjunction with the part of the rotary gears 571.

In the present exemplary embodiment, a rotary shaft 571X that rotatably supports the part of the rotary gears 571 is provided, and the rotary body 810 is attached to the upper end portion, in the drawing, of the rotary shaft 571X.

The transmission sensor 820 is provided with a light source 821 that emits light, and a light receiving section 822 that receives the light from the light source 821.

The rotary body 810 is provided with a plurality of projecting portions 811 that project from the center portion of the rotary body 810 in the radial direction toward the outer side of the rotary body 810 in the radial direction.

The plurality of projecting portions 811 are disposed radially. Gaps 812 that allow passage of the light emitted from the light source 821 provided in the transmission sensor 820 are provided between two adjacent projecting portions 811.

In the present exemplary embodiment, the plurality of projecting portions 811 sequentially pass between the light source 821 and the light receiving section 822 provided in the transmission sensor 820 along with rotation of the rotary body 810. In the present exemplary embodiment, the amount of rotation of the rotary body 810 is detected by the transmission sensor 820 sequentially detecting the plurality of projecting portions 811.

Information on the detected amount of rotation is output to the information processing section 100 (see FIG. 1), and the information processing section 100 detects the position of the second binding teeth 72 on the basis of the information on the amount of rotation.

Specifically, in the present exemplary embodiment, the relationship between the amount of rotation of the rotary body 810 and the amount of movement of the second binding teeth 72 is registered in advance in an information storage device 120 (to be discussed later), and the information processing section 100 specifies the amount of movement of the second binding teeth 72 on the basis of the relationship registered in the information storage device 120.

More specifically, when information on the amount of rotation of the rotary body 810 is acquired, the information processing section 100 specifies the amount of movement of the second binding teeth 72 with reference to the relationship described above registered in the information storage device 120. Then, the information processing section 100 detects the position of the second binding teeth 72 on the basis of the specified amount of movement.

Then, the information processing section 100 determines, on the basis of the detected position of the second binding teeth 72, whether or not the second binding teeth 72 are at a binding start position, a binding end position, or a pre-stop position to be discussed later.

Detection of the position of the second binding teeth 72 is not limited to being based on detection of the amount of rotation of the rotary body 810.

For example, a linear encoder that extends along the direction of movement of the second binding teeth 72 may be installed, and the position of the second binding teeth 72 may be detected by detecting the position of an interlocking portion interlocked with the second binding teeth 72 using the linear encoder.

Figure 12:
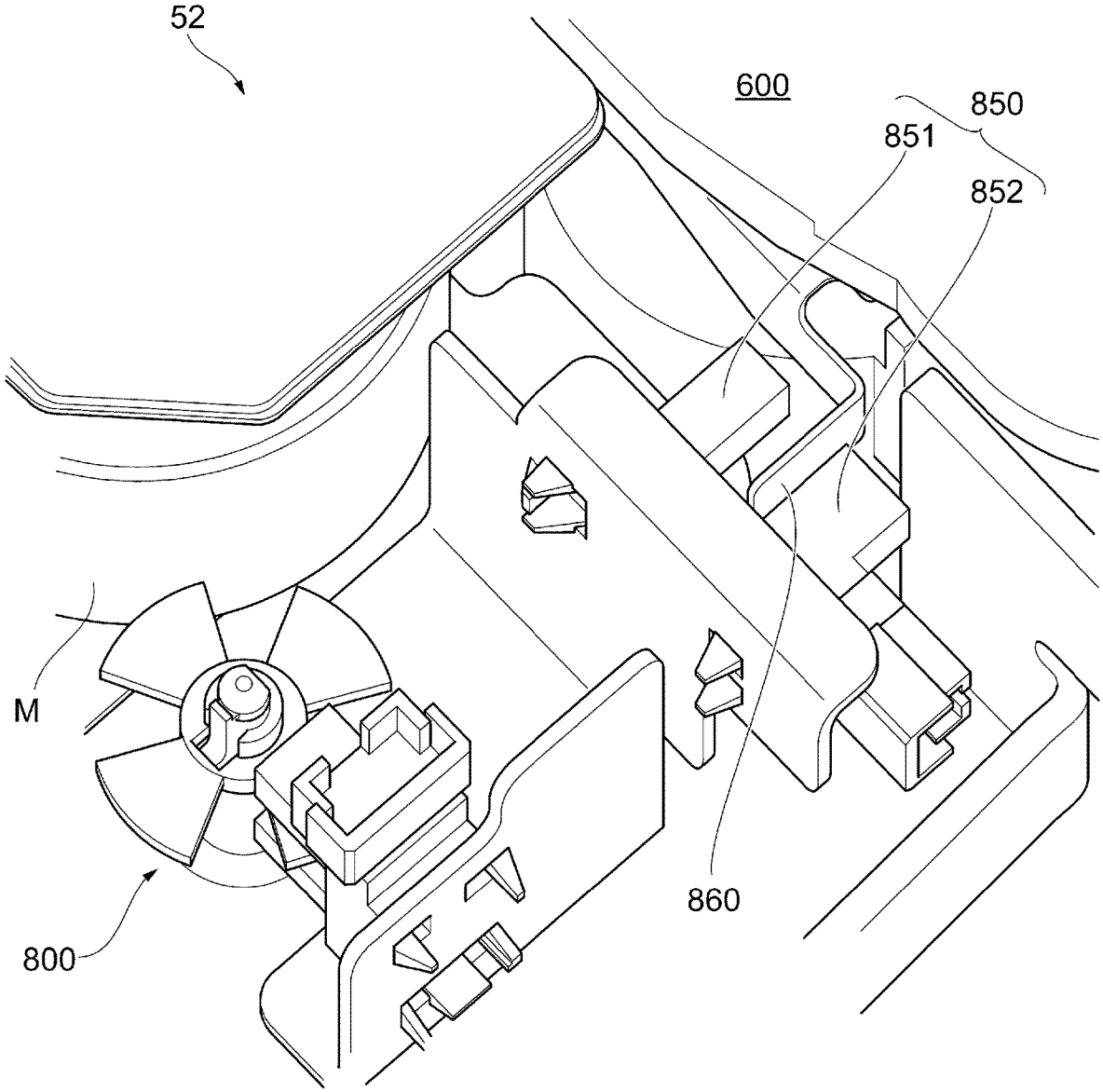
FIG. 12 illustrates the second binding device as seen from above.

FIG. 12 illustrates the second binding device 52 as seen from above.

The second binding device 52 according to the present exemplary embodiment is further provided with an initial position sensor 850 that detects that the second binding teeth 72 (not illustrated in FIG. 12) are located at an initial position determined in advance.

In the present exemplary embodiment, a projecting piece 860 that functions as an example of an interlocking portion that is moved in conjunction with the second binding teeth 72 is provided, and the initial position sensor 850 detects the projecting piece 860.

In the present exemplary embodiment, the information processing section 100 determines that the second binding teeth 72 are located at the initial position in the case where the projecting piece 860 is located at the location of installation of the initial position sensor 850 and the projecting piece 860 is detected by the initial position sensor 850.

The initial position sensor 850 is constituted from a transmission sensor that includes a light emitting section 851 and a light receiving section 852 that receives light from the light emitting section 851.

In the case where the projecting piece 860 is provided at the initial position sensor 850, the light from the light emitting section 851 is not detected by the light receiving section 852. In this case, the information processing section 100 (see FIG. 1) determines that the second binding teeth 72 are located at the initial position.

On the other hand, the information processing section 100 determines that the second binding teeth 72 are located at a position other than the initial position in the case where the light from the light emitting section 851 is detected by the light receiving section 852.

The projecting piece 860 is attached to the interlocking portion 600, and moved in accompaniment with the second binding teeth 72. In the present exemplary embodiment, it is detected that the second binding teeth 72 are located at the initial position when the projecting piece 860 is detected at the location of installation of the initial position sensor 850.

In the present exemplary embodiment, when a binding process is to be performed on the paper bundle T (see FIG. 5) by the first binding teeth 71 and the second binding teeth 72, the second binding teeth 72 are moved from the initial position toward the paper bundle T and the first binding teeth 71.

Figure 13:
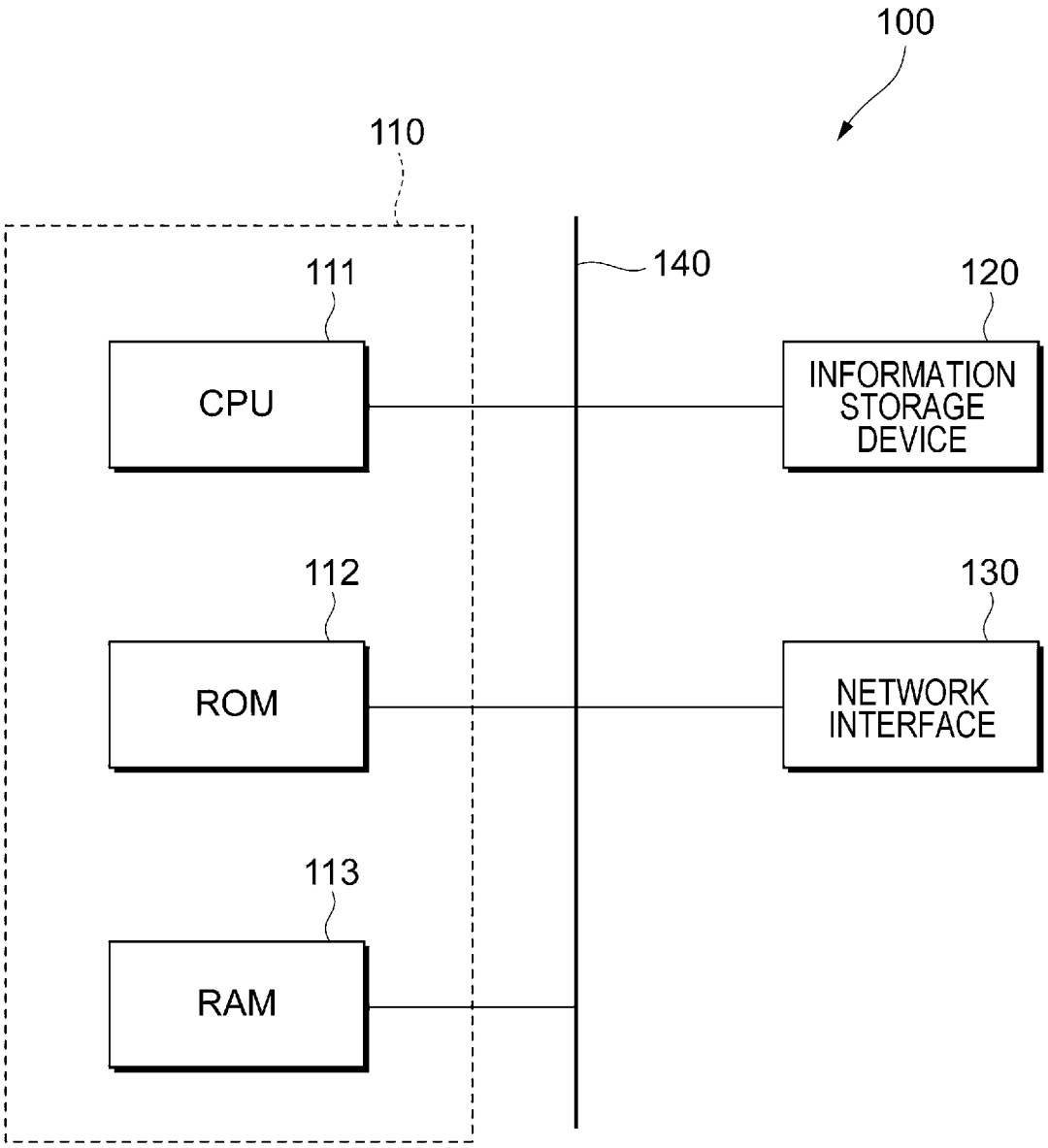
FIG. 13 illustrates the hardware configuration of an information processing section.

FIG. 13 illustrates the hardware configuration of the information processing section 100.

The information processing section 100 is provided with a processing section 110, an information storage device 120 that stores information, and a network interface 130 that achieves communication via a local area network (LAN) cable etc.

The processing section 110 is constituted from a computer.

The processing section 110 includes a central processing unit (CPU) 111 that serves as an example of a processor that executes various processes to be discussed later. The processing section 110 also includes a read only memory (ROM) 112 that stores software and a random access memory (RAM) 113 that is used as a work area.

The information storage device 120 is implemented by an existing device such as a hard disk drive, a semiconductor memory, and a magnetic tape.

The processing section 110, the information storage device 120, and the network interface 130 are connected to each other through a bus 140 or a signal line (not illustrated).

Programs to be executed by the CPU 111 may be provided to the information processing section 100 as stored in a computer-readable storage medium such as a magnetic storage medium (such as a magnetic tape and a magnetic disk), an optical storage medium (such as an optical disc), a magneto-optical storage medium, and a semiconductor memory. Alternatively, the programs to be executed by the CPU 111 may be provided to the information processing section 100 using a communication unit such as the Internet.

In the embodiments herein described, the term "processor" refers to hardware in a broad sense. Examples of the processor include general processors (e.g., CPU: Central Processing Unit) and dedicated processors (e.g., GPU:

Graphics Processing Unit, ASIC: Application Specific Integrated Circuit, FPGA: Field Programmable Gate Array, and programmable logic device).

In the embodiments herein described, the term "processor" is broad enough to encompass one processor or plural processors in collaboration which are located physically apart from each other but may work cooperatively. The order of operations of the processor is not limited to one described in the embodiments herein described, and may be changed.

Subsequently, functions implemented by the information processing section 100 will be described. In the following description, only functions related to the binding of the paper bundle T will be described. In the present exemplary embodiment, the information processing section 100 implements the following functions by the CPU 111, which serves as an example of a processor, executing the programs stored in the ROM 112 or the information storage device 120.

The information processing section 100 acquires paper bundle information which is information on the paper bundle T which is an example of a recording medium bundle. In other words, the information processing section 100 acquires paper bundle information which is information on the paper bundle T to be subjected to a binding process by the first binding teeth 71 and the second binding teeth 72.

In the present exemplary embodiment, as illustrated in FIG. 1, a reception device 915 that receives information input by a user is provided, although not described above.

In the present exemplary embodiment, the user inputs information that is necessary for the binding process by operating a touch screen provided in the reception device 915, for example.

The information processing section 100 acquires paper bundle information, which is information on the paper bundle T to be subjected to a binding process, from the information received by the reception device 915.

The user may input information by using a terminal apparatus such as a personal computer (PC) connected to the image forming system 1. In this case, the information processing section 100 acquires paper bundle information from the information received by the terminal apparatus.

The user starts the reception device 915 and the terminal apparatus, and inputs, as the paper bundle information, thickness information on the thickness of sheets of the paper P that constitute the paper bundle T, number-of-sheets information on the number of sheets of the paper P that constitute the paper bundle T, and type information on the type of sheets of the paper P that constitute the paper bundle T, for example.

Accordingly, the information processing section 100 acquires the thickness information, the number-of-sheets information, and the type information as the paper bundle information.

Such information is occasionally included in job information, and the information processing section 100 occasionally acquires such information on the basis of information included in the job information.

The information processing section 100 sets, on the basis of the acquired paper bundle information, a binding start position at which the second binding teeth 72 start a process of binding the paper bundle T in the direction of movement of the second binding teeth 72. The information processing section 100 further sets, on the basis of the acquired paper bundle information, a binding end position at which the second binding teeth 72 finish the process of binding the paper bundle T in the direction of movement of the second binding teeth 72.

In the present exemplary embodiment, when a process of binding the paper bundle T is performed, the second binding teeth 72 are moved from the initial position toward the first binding teeth 71 with the paper bundle P present between the first binding teeth 71 and the second binding teeth 72. Then, the second binding teeth 72 contact a surface of the paper bundle T, more specifically a surface of one of sheets of the paper P constituting the paper bundle T that is the closest to the second binding teeth 72, and thereafter are moved further toward the first binding teeth 71. In this event, the paper bundle T positioned between the first binding teeth 71 and the second binding teeth 72 is sandwiched between the first binding teeth 71 and the second binding teeth 72 to be pressed. Consequently, the binding process is performed on the paper bundle T. When the process of binding the paper bundle T is finished with the paper bundle T at a portion pressed between the first binding teeth 71 and the second binding teeth 72 brought to a thickness determined in advance, the second binding teeth 72 are stopped. After that, when the second binding teeth 72 are retracted in the direction of moving away from the first binding teeth 71 and moved to the initial position by way of a pre-stop position to be discussed later, the sequence of processes is finished.

Figure 14:
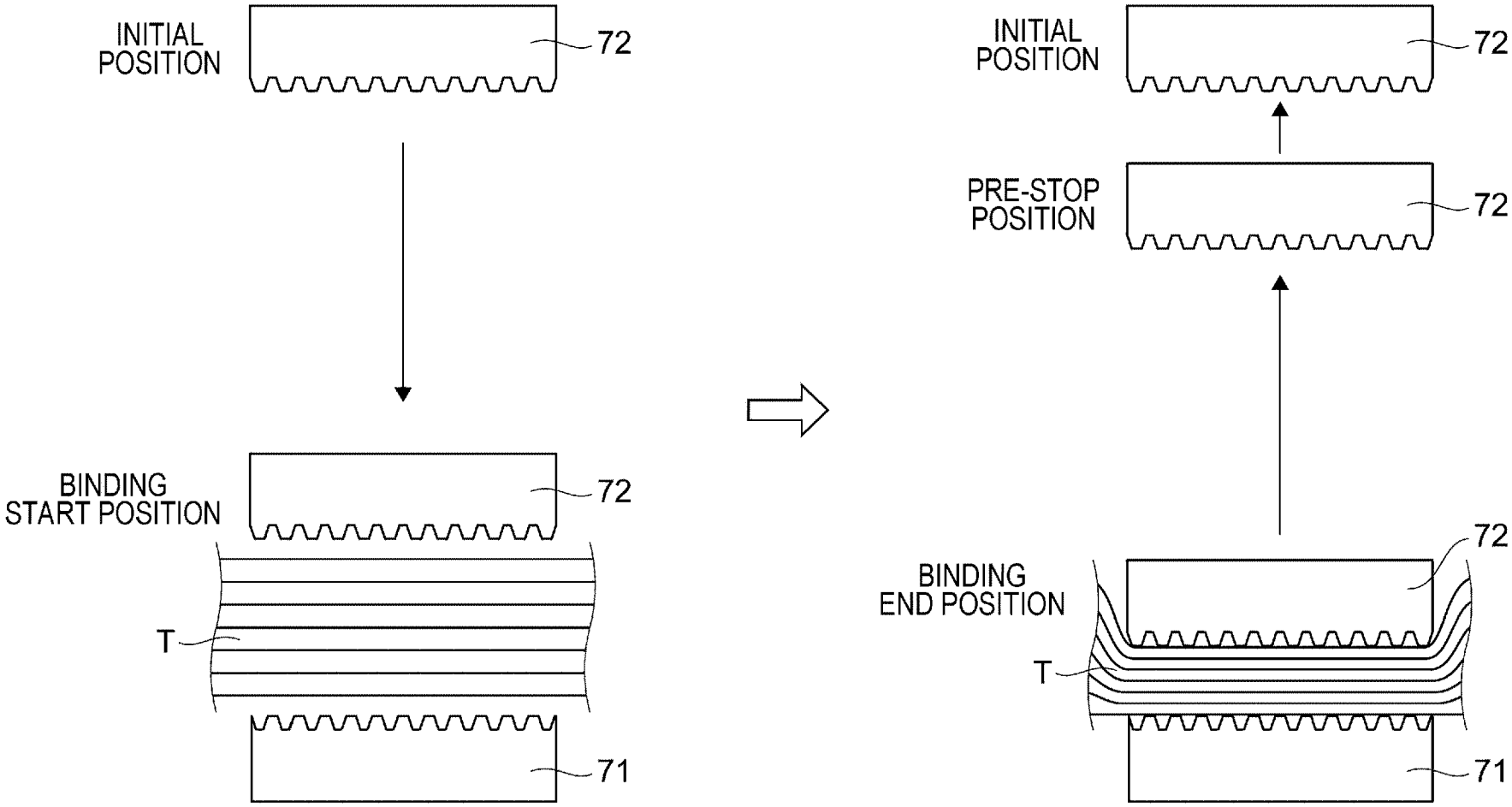
FIG. 14 illustrates the position of second binding teeth in the direction of movement at the time when a binding process is performed.

FIG. 14 illustrates the position of the second binding teeth 72 in the direction of movement at the time when a binding process is performed.

The information processing section 100 sets a position at which the second binding teeth 72 contact a surface of the paper bundle T before a binding process as the binding start position for the second binding teeth 72. The information processing section 100 may set a position at which the second binding teeth 72 do not contact a surface of the paper bundle T before a binding process as the binding start position for the second binding teeth 72.

The information processing section 100 also sets a position at which a portion of the paper bundle T to be pressed between the first binding teeth 71 and the second binding teeth 72 has a thickness determined in advance as the binding end position for the second binding teeth 72. The thickness determined in advance of a portion of the paper bundle T to be pressed between the first binding teeth 71 and the second binding teeth 72 means such a thickness that sheets of the paper P that constitute the paper bundle T are pressure-bonded to each other when the sheets of the paper P are pressed between the first binding teeth 71 and the second binding teeth 72 to the thickness.

The binding start position and the binding end position for the second binding teeth 72 are different in accordance with the thickness of sheets of the paper P that constitute the paper bundle T to be subjected to a binding process, the number of sheets of the paper P that constitute the paper bundle T, the type of sheets of the paper P that constitute the paper bundle T, etc.

Thus, the information processing section 100 sets a binding start position and a binding end position for the second binding teeth 72 on the basis of the thickness information, the number-of-sheets information, the type information, etc. included in the acquired paper bundle information.

The information processing section 100 stores, as information about positions in the direction of movement of the second binding teeth 72, the initial position discussed above and a pre-stop position in the information storage device 120, the pre-stop position being set between the initial position and the binding start position at a distance determined in advance in the direction of movement of the second binding teeth 72 from the initial position.

After a process of binding the paper bundle T is finished, the second binding teeth 72 are moved from the binding end position to the initial position by way of the pre-stop position, as discussed in detail later.

In the following description, information about the binding start position and the binding end position set by the information processing section 100 on the basis of the paper bundle information and the initial position and the pre-stop position stored in the information storage device 120 will occasionally be referred to as set position information.

In addition, the information processing section 100 detects the position of the second binding teeth 72.

Specifically, the information processing section 100 detects the position of the second binding teeth 72 in the direction of movement (hereinafter referred to as a "moving-direction position") during movement of the second binding teeth 72 with respect to the first binding teeth 71.

In the present exemplary embodiment, the information processing section 100 detects the moving-direction position of the second binding teeth 72 by acquiring information on the amount of movement of a portion interlocked with movement of the second binding teeth 72.

Specifically, in the present exemplary embodiment, the information processing section 100 detects the moving-direction position of the second binding teeth 72 by acquiring information on the amount of rotation of a rotary portion that is rotated in conjunction with movement of the second binding teeth 72.

More specifically, the information processing section 100 detects the moving-direction position of the second binding teeth 72 by acquiring information on the amount of rotation of the rotary body 810 described above provided in the position detection sensor 800 (see FIG. 10) from the position detection sensor 800.

More specifically, the information processing section 100 detects the moving-direction position of the second binding teeth 72 on the basis of information on the amount of rotation of the rotary body 810 and information from the initial position sensor 850 (see FIG. 12).

More specifically, the information processing section 100 detects the moving-direction position of the second binding teeth 72 on the basis of the amount of rotation of the rotary body 810 made since the projecting piece 860 is not detected by the initial position sensor 850.

In other words, the information processing section 100 detects the moving-direction position of the second binding teeth 72 on the basis of the amount of rotation of the rotary body 810 made since the second binding teeth 72 started the initial position.

In the present exemplary embodiment, the amount of movement of the second binding teeth 72 per one rotation of the rotary body 810 (hereinafter referred to as an "amount of movement per one rotation") is stored in the information storage device 120, although not described above.

When information on the amount of rotation of the rotary body 810 is acquired from the position detection sensor 800, the information processing section 100 acquires information on the amount of movement of the second binding teeth 72 by multiplying the amount of rotation of the rotary body 810 by the amount of movement per one rotation.

Consequently, the information processing section 100 detects the moving-direction position of the second binding teeth 72 for the case where the initial position is set to the origin.

In addition, the information processing section 100 determines, on the basis of the detected moving-direction position of the second binding teeth 72, whether or not the second binding teeth 72 are at the binding start position, the binding end position, or the pre-stop position discussed above.

In addition, the information processing section 100 executes various processes related to the binding of the paper bundle T.

Specifically, the information processing section 100 controls movement of the second binding teeth 72 on the basis of the detected moving-direction position of the second binding teeth 72 and the set position information set on the basis of the paper bundle information or stored in the information storage device 120. For an additional description, the information processing section 100 controls movement of the second binding teeth 72 by controlling operation of the drive motor M and the electromagnetic clutch 563. In the present exemplary embodiment, the information processing section 100 controls start and stop of drive of the drive motor M, but does not vary the rotational speed of the drive motor M.

In a state (hereinafter referred to as an "initial state") before a binding process is started with no paper bundle T present between the first binding teeth 71 and the second binding teeth 72, the information processing section 100 stops the second binding teeth 72 at the initial position by stopping drive of the drive motor M. In the initial state, in addition, the information processing section 100 brings the electromagnetic clutch 563 into a state (hereinafter referred to as a "disengaged state") in which the output shaft of the drive motor M and the switching gear 562 are disengaged from each other.

To start a binding process with the paper bundle T transported to a space between the first binding teeth 71 and the second binding teeth 72, the information processing section 100 starts drive of the drive motor M to rotate the drive motor M forward. Since the electromagnetic clutch 563 has been brought into the disengaged state as discussed above, a drive force of the drive motor M is transferred to the second binding teeth 72 via the second transfer portion 580, rather than being transferred to the first transfer portion 570. The second binding teeth 72 are moved from the initial position toward the first binding teeth 71 at the second moving speed V2 by the drive force transferred via the second transfer portion 580.

When the second binding teeth 72 reach the binding start position, the information processing section 100 switches the electromagnetic clutch 563 from the disengaged state to a state (hereinafter referred to as an "engaged state") in which the output shaft of the drive motor M and the switching gear 562 are engaged with each other while the drive motor M is kept rotating forward. Consequently, a drive force of the drive motor M is transferred to the second binding teeth 72 via the first transfer portion 570. The second binding teeth 72 are moved from the binding start position toward the first binding teeth 71 at the first moving speed V1 by the drive force transferred via the first transfer portion 570.

While the drive force of the drive motor M is also transferred to the second transfer portion 580, the drive force is not transferred from the second transfer portion 580 to the second binding teeth 72 by the action of the torque limiter 584 of the second transfer portion 580.

When the second binding teeth 72 reach the binding end position, the information processing section 100 stops drive of the drive motor M. In addition, the information processing section 100 switches the electromagnetic clutch 563 from the engaged state to the disengaged state. After that, the information processing section 100 starts drive of the drive motor M to rotate the drive motor M in reverse. Consequently, a drive force of the drive motor M is transferred to the second binding teeth 72 via the second transfer portion 580. The second binding teeth 72 are moved from the binding end position toward the initial position at the second moving speed V2 by the drive force transferred via the second transfer portion 580.

When the second binding teeth 72 reach the pre-stop position, the information processing section 100 switches the electromagnetic clutch 563 from the disengaged state to the engaged state while the drive motor M is kept rotating in reverse. Consequently, a drive force of the drive motor M is transferred to the second binding teeth 72 via the first transfer portion 570. The second binding teeth 72 are moved from the pre-stop position toward the initial position at the first moving speed V1 by the drive force transferred via the first transfer portion 570.

After that, when the second binding teeth 72 reach the initial position, the information processing section 100 stops drive of the drive motor M. Consequently, the second binding teeth 72 are stopped at the initial position.

In this manner, the information processing section 100 according to the present exemplary embodiment transfers the drive force of the drive motor M to the second binding teeth 72 via the first transfer portion 570 when the second binding teeth 72 are moved from the binding start position to the binding end position. In other words, the information processing section 100 transfers the drive force of the drive motor M to the second binding teeth 72 via the first transfer portion 570 when the paper bundle T is sandwiched and pressed between the first binding teeth 71 and the second binding teeth 72.

As discussed above, torque that acts when the drive force is transferred via the first transfer portion 570 is larger than torque that acts when the drive force is transferred via the second transfer portion 580.

In the present exemplary embodiment, a large load may be applied to the paper bundle T by transferring the drive force of the drive motor M to the second binding teeth 72 via the first transfer portion 570, compared to the case where the drive force of the drive motor M is transferred via the second transfer portion 580, when the paper bundle T is sandwiched and pressed between the first binding teeth 71 and the second binding teeth 72.

Figure 15:
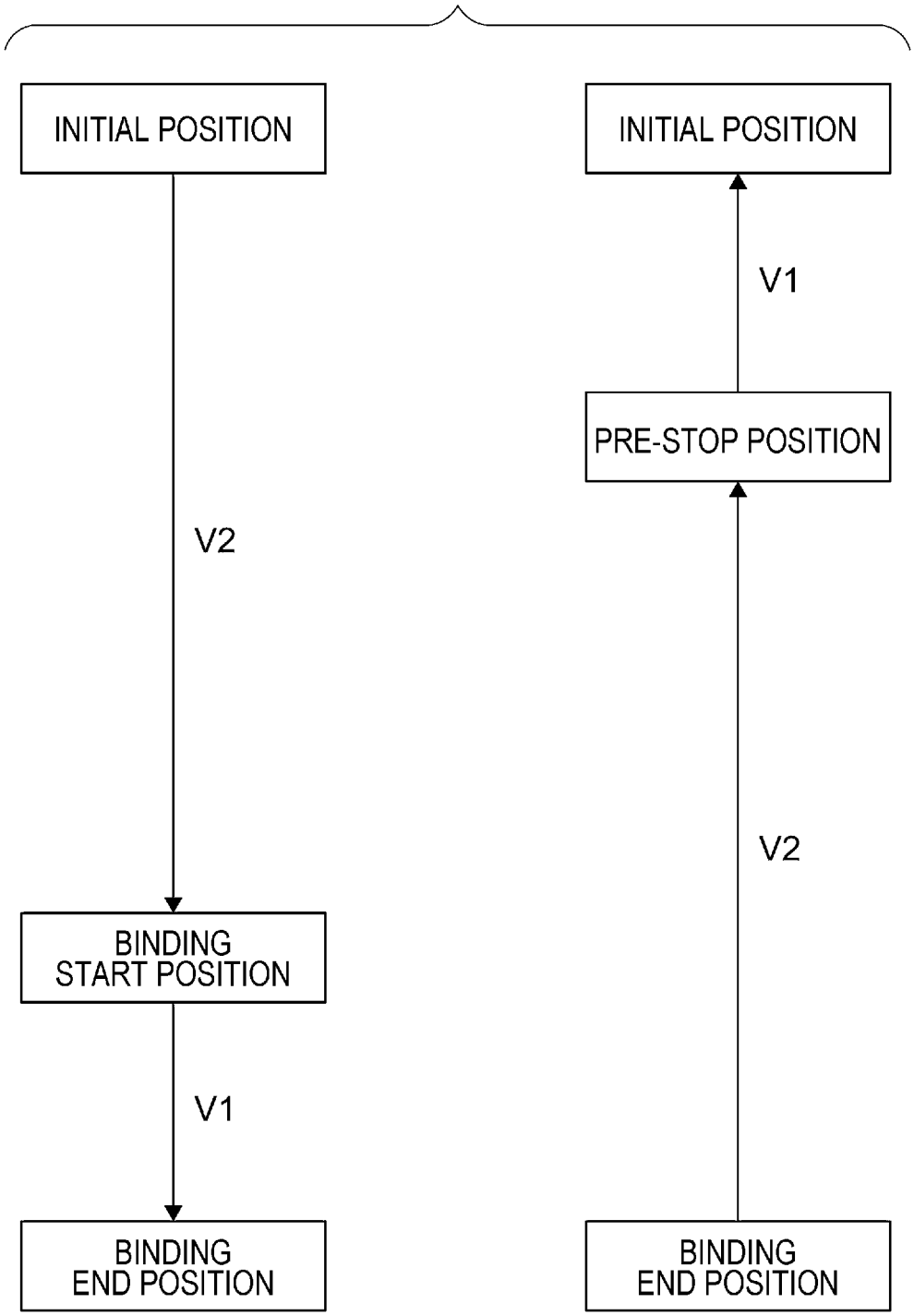
FIG. 15 illustrates the relationship between the position of the second binding teeth in the direction of movement and the speed of movement of the second binding teeth.

FIG. 15 illustrates the relationship between the position of the second binding teeth 72 in the direction of movement and the speed of movement of the second binding teeth 72.

In the present exemplary embodiment, as illustrated in FIG. 15, in the case where the second binding teeth 72 are moved in a process of binding the paper bundle T, the second binding teeth 72 are moved at the second moving speed V2 from the initial position to the binding start position, and moved at the first moving speed V1 from the binding start position to the binding end position. In addition, the second binding teeth 72 are moved at the second moving speed V2 from the binding end position to the pre-stop position, and moved at the first moving speed V1 from the pre-stop position to the initial position.

That is, in the present exemplary embodiment, in the case where the second binding teeth 72 are moved toward the first binding teeth 71, the moving speed (second moving speed V2) at which the second binding teeth 72 are moved from the initial position to the binding start position is higher than the moving speed (first moving speed V1) at which the second binding teeth 72 are moved from the binding start position to the binding end position.

Consequently, the time required for movement of the second binding teeth 72 in the case where a process of binding the paper bundle T is performed is shortened compared to the case where the second binding teeth 72 are moved at the first moving speed V1 from the initial position to the binding end position, for example.

In the present exemplary embodiment, after a process of binding the paper bundle T is finished, the moving speed (first moving speed V1) at which the second binding teeth 72 are moved from the pre-stop position to the initial position is lower than the moving speed (second moving speed V2) at which the second binding teeth 72 are moved from the binding end position to the pre-stop position.

As discussed above, when the second binding teeth 72 reach the initial position after a process of binding the paper bundle T is finished, the information processing section 100 stops movement of the second binding teeth 72 by stopping drive of the drive motor M. In this event, there is occasionally a time difference since the initial position sensor 850 detects that the second binding teeth 72 have reached the initial position until the information processing section 100 actually stops movement of the second binding teeth 72 by stopping drive of the drive motor M. In this case, if the moving speed of the second binding teeth 72 which are moved toward the initial position is high, the position at which the second binding teeth 72 are actually stopped tends to deviate from the initial position. If the position at which the second binding teeth 72 are stopped deviates from the initial position, the precision in the next process of binding the paper bundle T may be lowered.

In the present exemplary embodiment, in contrast, the moving speed at which the second binding teeth 72 are moved from the pre-stop position to the initial position is lower than the moving speed at which the second binding teeth 72 are moved from the binding end position to the pre-stop position, which allows the second binding teeth 72 to be stopped at the initial position when drive of the drive motor M is stopped.

In the exemplary embodiment discussed above, the information processing section 100 determines whether or not the second binding teeth 72 are located at the binding start position or the binding end position on the basis of information acquired from the position detection sensor 800. However, this is not limiting. The information processing section 100 may determine whether or not the second binding teeth 72 are located at the binding start position or the binding end position by referencing the current value of a current supplied to the drive motor M, for example.

That is, when the second binding teeth 72 contact the surface of the paper bundle T and the first binding teeth 71 and the second binding teeth 72 start pressing the paper bundle T in the case where the second binding teeth 72 are moved toward the first binding teeth 71, the current value of a current supplied to the drive motor M starts increasing. In this case, the information processing section 100 may determine that the second binding teeth 72 have reached the binding start position.

When the second binding teeth 72 are further moved toward the first binding teeth 71 after the paper bundle T is pressed between the first binding teeth 71 and the second binding teeth 72, meanwhile, the current value of a current supplied to the drive motor M is not increased, or the rate of increase in the current value is reduced. In this case, the information processing section 100 may determine that the second binding teeth 72 have reached the binding end position.

Second Exemplary Embodiment

Subsequently, a second binding device 52 according to a second exemplary embodiment of the present disclosure will be described. Components that are similar to those according to the first exemplary embodiment discussed above are denoted by similar reference numerals to omit detailed description thereof.

Figure 16:
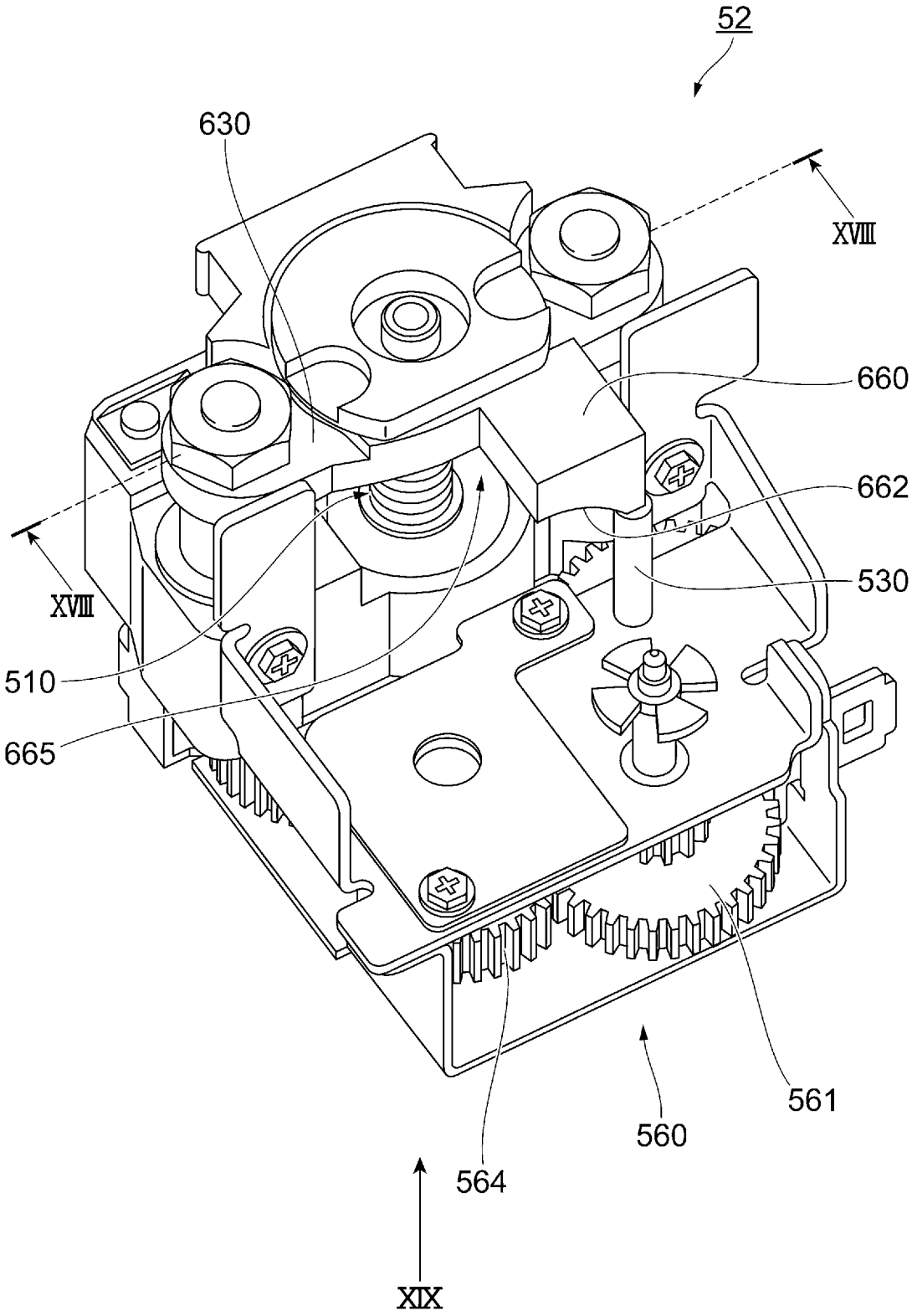
FIG. 16 illustrates the state of a second binding device according to a second exemplary embodiment on the back surface side.
Figure 17:
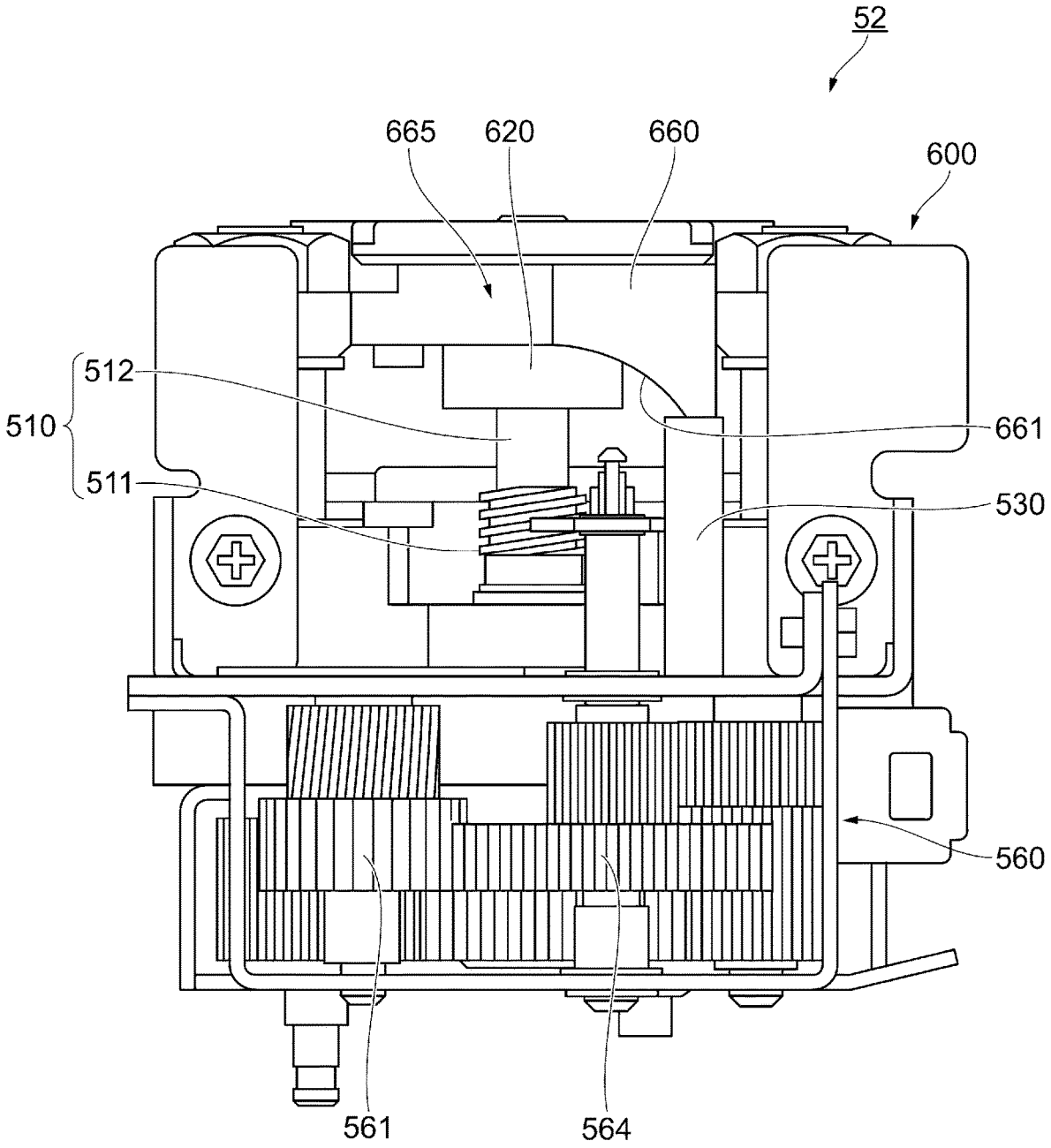
FIG. 17 illustrates the second binding device as seen from the back surface side.

FIG. 16 illustrates the state of the second binding device 52 according to the second exemplary embodiment on the back surface side. FIG. 17 illustrates the second binding device 52 as seen from the back surface side. In FIGS. 16 and 17, the drive motor M and a link mechanism 569, to be discussed later, of the transfer portion 560 are not illustrated.

Figure 18:
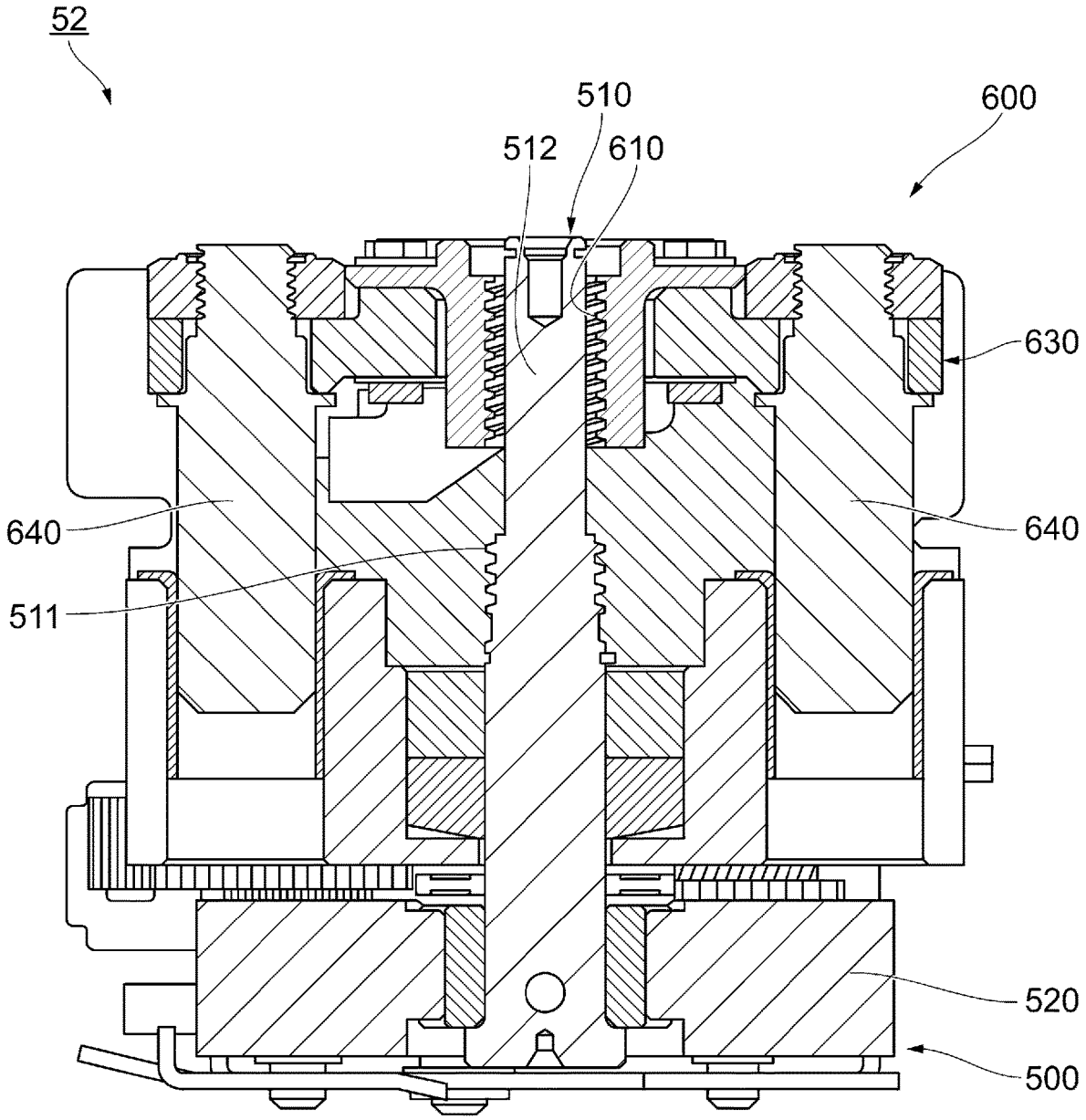
FIG. 18 illustrates a sectional surface of the second binding device taken along a line XVIII-XVIII in FIG. 16.

FIG. 18 illustrates a sectional surface of the second binding device 52 taken along a line XVIII-XVIII in FIG. 16.

Figure 19:
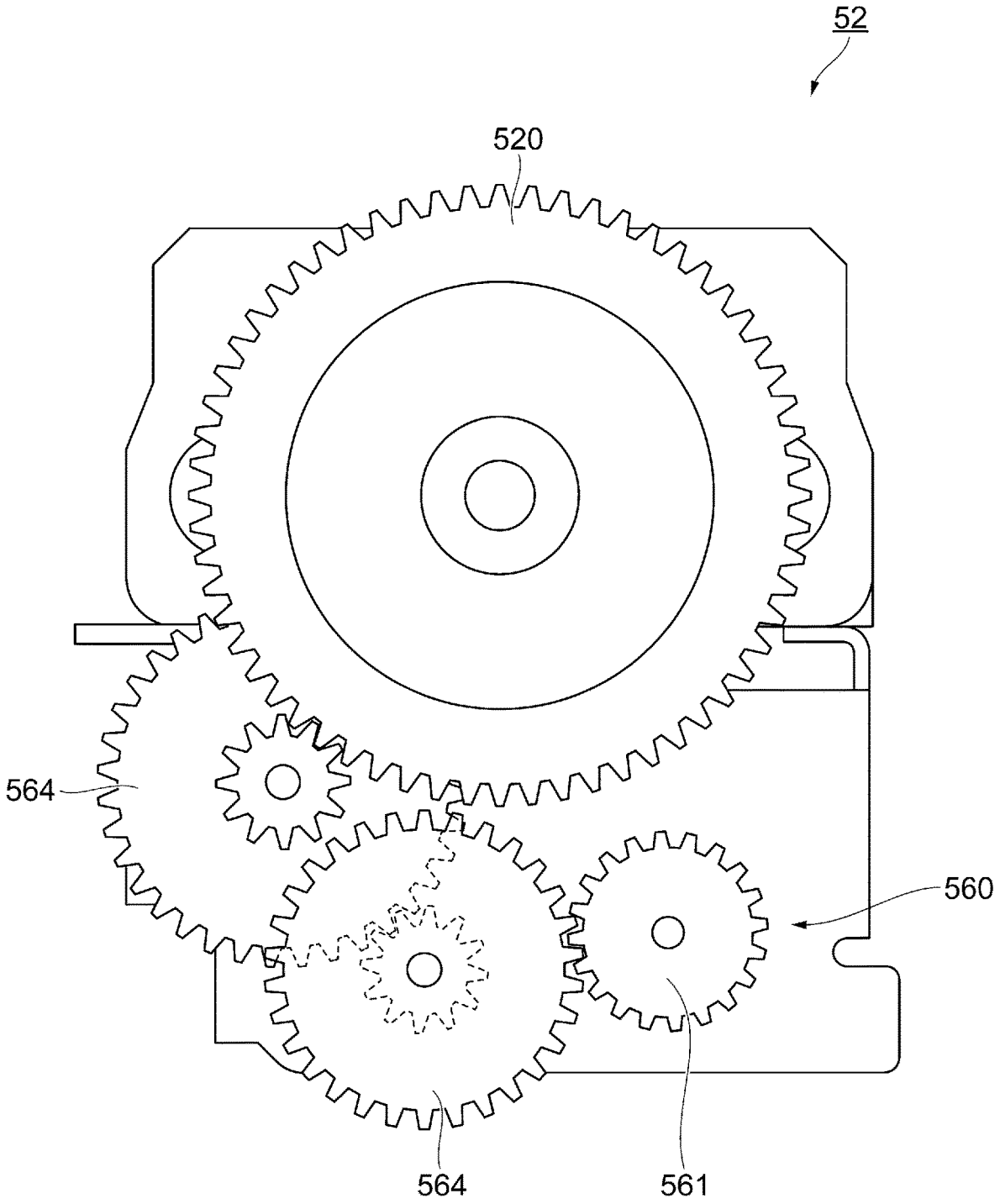
FIG. 19 illustrates the second binding device as seen from the direction of an arrow XIX in FIG. 16.

FIG. 19 illustrates the second binding device 52 as seen from the direction of an arrow XIX in FIG. 16 (from below). In FIG. 19, a housing that covers members of a transfer portion 560 is not illustrated.

The second binding device 52 according to the second exemplary embodiment is different from the second binding device 52 according to the first exemplary embodiment in the configuration of the moving mechanism 500, the interlocking portion 600, and the transfer portion 560.

For a specific description, the moving mechanism 500 according to the first exemplary embodiment discussed above includes the screw member 510 and the large-diameter gear 520, and moves the second binding teeth 72 by rotating the screw member 510 in the circumferential direction. In contrast, the moving mechanism 500 according to the second exemplary embodiment includes, in addition to the screw member 510 and the large-diameter gear 520, a support column member 530 that moves the second binding teeth 72 by moving in a horizontal direction (left-right direction in FIGS. 17 and 18) that is orthogonal to the direction of movement of the second binding teeth 72. In the moving mechanism 500 according to the second exemplary embodiment, the shape of the screw member 510 is different from that according to the first exemplary embodiment.

The screw member 510 according to the present exemplary embodiment includes a screw portion 511, on the outer peripheral portion of which male threads are formed, and an extension portion 512 that extends upward from the screw portion 511.

Male threads in which projecting portions and groove portions are arranged at constant intervals are formed on the outer peripheral surface of the screw portion 511. The screw portion 511 may be meshed with a portion of the interlocking portion 600 provided with the female thread portion 610.

Male threads are not formed on the outer peripheral surface of the extension portion 512. The extension portion 512 has a circular column outer shape. The outside diameter of the extension portion 512 is smaller than the outside diameter of the screw portion 511. The outside diameter of the extension portion 512 is smaller than the inside diameter of the female thread portion 610 of the interlocking portion 600.

In the example illustrated in FIG. 18, the extension portion 512 of the screw member 510 is inserted through the inside of the female thread portion 610 of the interlocking portion 600. In other words, in the example illustrated in FIG. 18, the extension portion 512 of the screw member 510 penetrates the female thread portion 610.

As discussed in detail later, the screw member 510 according to the present exemplary embodiment is switched between a state in which the extension portion 512 is inserted through the inside of the female thread portion 610 and a state in which the screw portion 511 is meshed with the female thread portion 610 along with movement of the interlocking portion 600 relative to the screw member 510.

The support column member 530 has a circular column shape, the axial direction of which extends in the direction of movement of the second binding teeth 72. The support column member 530 is not limited to having a circular column shape as long as the support column member 530 extends along the direction of movement of the second binding teeth 72. The support column member 530 is moved in a direction that is perpendicular to the direction of movement of the second binding teeth 72 upon receiving a drive force via the link mechanism 569 to be discussed later.

The interlocking portion 600 according to the second exemplary embodiment includes a facing member 660 attached to the side of the back surface of the upper support member 630 to face the support column member 530 from the upper side.

The facing member 660 faces the support column member 530, and includes a curved surface portion 662 formed from a curved surface, the distance of which from the lower end of the support column member 530 becomes longer from the right side toward the left side in the drawing. For an additional description, the facing member 660 which includes the curved surface portion 662 has a thickness in the up-down direction that becomes smaller from the right side toward the left side in the drawing.

The interlocking portion 600 according to the second exemplary embodiment is provided with a retracted position 665 which is provided adjacently on the left side in the drawing with respect to the facing member 660 and at which the support column member 530 is retracted. As discussed in detail later, the support column member 530 and the facing member 660 do not contact each other in the case where the support column member 530 is present at the retracted position 665.

Subsequently, the transfer portion 560 according to the present exemplary embodiment will be described.

As illustrated in FIG. 19 etc., the transfer portion 560 according to the present exemplary embodiment includes a drive gear 561 that is rotated upon receiving a drive force from the drive motor M (first exemplary embodiment; see FIG. 10), and a plurality of rotary gears 564 that receive a rotational drive force from the drive gear 561 to transfer the rotational drive force to the large-diameter gear 520.

In the present exemplary embodiment, a drive force from the drive motor M is transferred to the screw member 510 via the drive gear 561, the rotary gears 564, and the large-diameter gear 520. Then, the drive force transferred to the screw member 510 is transferred to the second binding teeth 72 in the case where the screw portion 511 of the screw member 510 is meshed with the female thread portion 610 of the interlocking portion 600. Consequently, the second binding teeth 72 are moved toward the first binding teeth 71, and the second binding teeth 72 are retracted from the first binding teeth 71.

The transfer portion 560 according to the present exemplary embodiment also includes a link mechanism 569 that transfers a drive force from the drive motor M to the support column member 530. The link mechanism 569 is connected to the rotary gears 564 which are rotated upon receiving a rotational drive force from the drive motor M. The link mechanism 569 receives a rotational drive force from the rotary gears 564, converts the rotational drive force into linear motion, and transfers the linear motion to the support column member 530. The link mechanism 569 may be a mechanism known in the art that converts rotational motion into linear motion, although not described in detail herein.

In the present exemplary embodiment, the support column member 530 and the link mechanism 569 are an example of a different moving unit.

Figure 20:
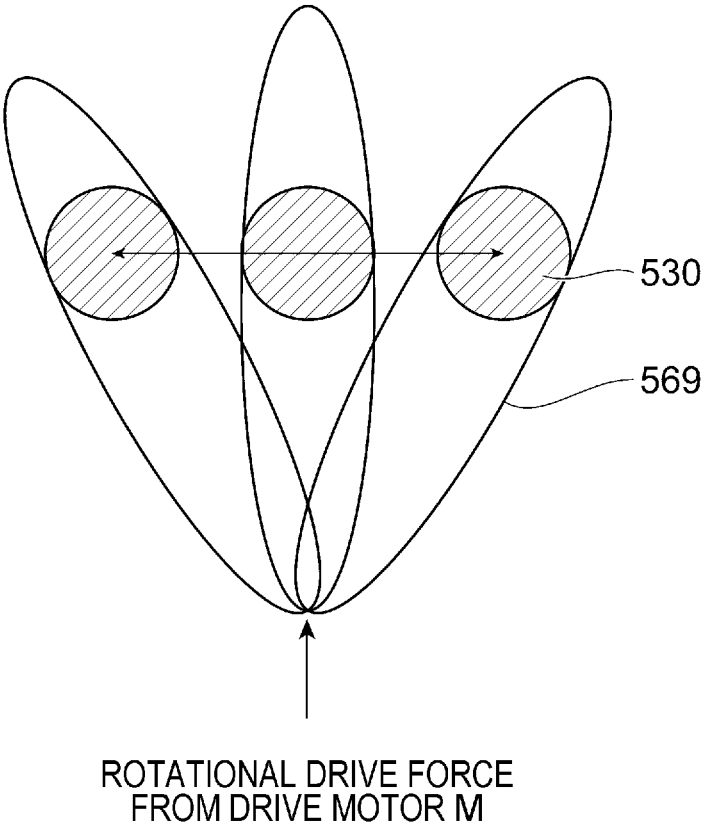
FIG. 20 is a schematic diagram illustrating the mode of movement of a support column member by a link mechanism.

FIG. 20 is a schematic diagram illustrating the mode of movement of the support column member 530 by the link mechanism 569. FIG. 20 corresponds to a view of the support column member 530 as seen from the upper side.

In the present exemplary embodiment, when a drive force from the drive motor M is transferred to the support column member 530 via the link mechanism 569, the support column member 530 is moved in the horizontal direction. A drive force is transferred from the support column member 530 to the facing member 660 in the case where the support column member 530 and the facing member 660 of the interlocking portion 600 are in contact with each other. Consequently, the second binding teeth 72 are moved toward the first binding teeth 71, and the second binding teeth 72 are retracted from the first binding teeth 71.

Figure 21A:
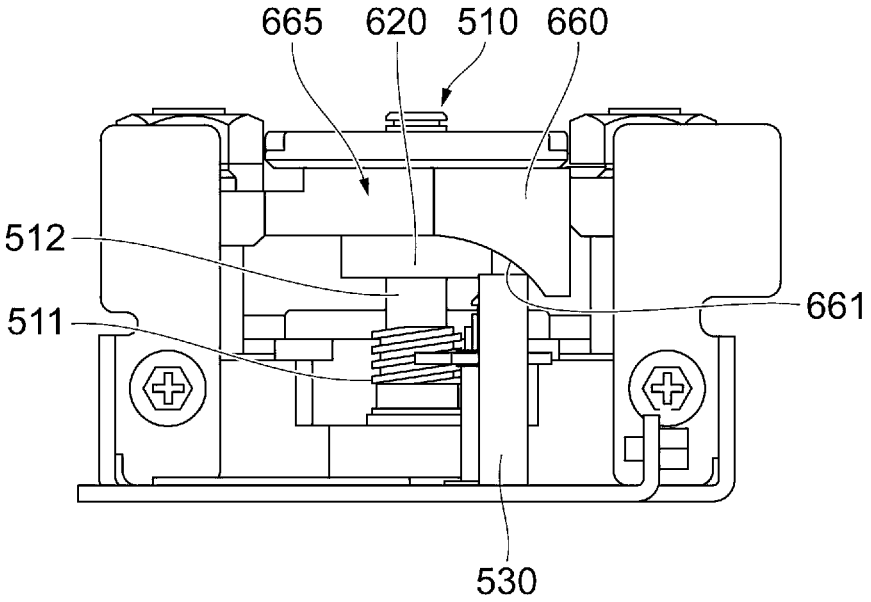
FIGS. 21A and 21B illustrate the second binding device according to the second exemplary embodiment as seen from the back surface side.
Figure 21B:
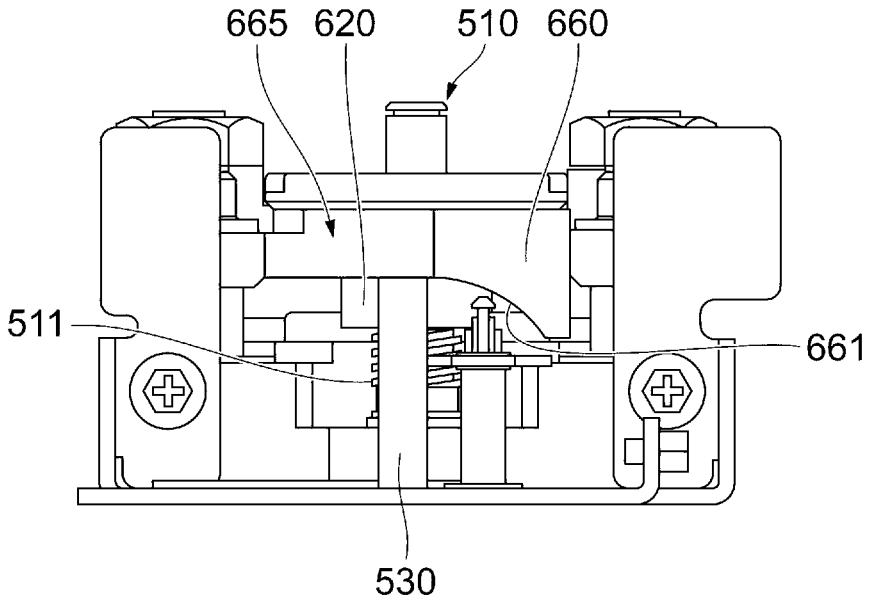

FIGS. 21A and 21B illustrate the second binding device 52 according to the second exemplary embodiment as seen from the back surface side. In FIGS. 21A and 21B, the drive motor M and the link mechanism 569, to be discussed later, of the transfer portion 560 are not illustrated.

Subsequently, operation of the second binding device 52 for the case where a process of binding the paper bundle T is performed on the basis of control by the information processing section 100 will be described with reference to FIGS. 21A and 21B and FIGS. 17, 18, etc. discussed above.

As in the first exemplary embodiment, in the initial state, the information processing section 100 (see FIG. 13 etc.) stops drive of the drive motor M, and stops the second binding teeth 72 at the initial position. At this time, as illustrated in FIG. 18, the screw portion 511 of the screw member 510 is not meshed with the female thread portion 610 of the interlocking portion 600, and the extension portion 512 of the screw member 510 penetrates the female thread portion 610. In addition, as illustrated in FIG. 17, the upper end surface of the support column member 530 is in contact with the rightmost side, in the drawing, of the curved surface portion 662 of the facing member 660.

To start a binding process with the paper bundle T transported to a space between the first binding teeth 71 and the second binding teeth 72, the information processing section 100 starts drive of the drive motor M to rotate the drive motor M forward.

In this case, a rotary drive force of the drive motor M is transferred to the link mechanism 569 via the drive gear 561 and the rotary gears 564. The rotational drive force transferred to the link mechanism 569 is converted into linear motion and transferred to the support column member 530, and the support column member 530 is moved in the horizontal direction. For an additional description, the support column member 530 is moved horizontally from the right side toward the left side in the drawing, as illustrated in FIGS. 17 and 21A. For a further additional description, the support column member 530 is moved horizontally from the right side toward the left side in the drawing with respect to the facing member 660 while contacting the curved surface portion 662 of the facing member 660.

As discussed above, the facing member 660 has a thickness in the up-down direction that becomes smaller from the right side toward the left side in the drawing. Consequently, when the support column member 530 is moved from the right side to the left side in the drawing with respect to the facing member 660 while contacting the curved surface portion 662, the entire interlocking portion 600 is moved from the upper side to the lower side in the drawing with respect to the moving mechanism 500 via the facing member 660.

Consequently, the second binding teeth 72 are moved toward the first binding teeth 71.

In addition, when the interlocking portion 600 is moved from the upper side to the lower side in the drawing with respect to the moving mechanism 500, the female thread portion 610 of the interlocking portion 600 is moved from the upper side to the lower side in the drawing with respect to the extension portion 512 of the screw member 510.

A rotational drive force of the drive motor M is also transferred to the screw member 510 via the drive gear 561, the rotary gears 564, and the large-diameter gear 520 to rotate the screw member 510. Since the screw portion 511 of the screw member 510 is not meshed with the female thread portion 610 as discussed above, however, the drive force is not transferred from the screw member 510 to the second binding teeth 72.

Subsequently, when the support column member 530 is further moved to reach the retracted position 665 as illustrated in FIG. 21B, the support column member 530 and the facing member 660 (curved surface portion 662) do not contact each other. In this case, movement of the interlocking portion 600 made by the support column member 530 is stopped.

When the support column member 530 reaches the retracted position 665, the female thread portion 610 of the interlocking portion 600 which has been moved from the upper side to the lower side in the drawing with respect to the screw member 510 is meshed with the screw portion 511 of the screw member 510.

Consequently, a drive force of the drive motor M is transferred to the interlocking portion 600 via the drive gear 561, the rotary gears 564, the large-diameter gear 520, and the screw member 510, and transferred to the second binding teeth 72 via the interlocking portion 600. Consequently, the second binding teeth 72 are moved toward the first binding teeth 71.

After that, a binding process is performed on the paper bundle T by the paper bundle T being pressed between the second binding teeth 72, which are moved by a drive force transferred via the large-diameter gear 520, the screw member 510, etc., and the first binding teeth 71.

In general, the moving speed of the second binding teeth 72 being moved by rotating a screw such as the screw member 510 tends to be lower than the moving speed of the second binding teeth 72 being moved without using a screw.

On the other hand, in the case where a process of binding the paper bundle T is performed by pressing the paper bundle T using the first binding teeth 71 and the second binding teeth 72, the second binding teeth 72 are preferably moved using a screw such as the screw member 510 from the viewpoint of applying a load that is necessary for the binding process to the paper bundle T.

In the present exemplary embodiment, as discussed above, in the case where the second binding teeth 72 are moved toward the first binding teeth 71, the second binding teeth 72 are moved via the support column member 530, rather than using the screw member 510, during a period for which the second binding teeth 72 are moved from the initial position to a position (e.g. the binding start position) determined in advance. Consequently, the time required for movement of the second binding teeth 72 in the case where a process of binding the paper bundle T is performed is shortened compared to the case where the second binding teeth 72 are moved using the screw member 510.

In the present exemplary embodiment, as discussed above, the second binding teeth 72 are moved via the screw member 510 in the case where the paper bundle T is pressed between the first binding teeth 71 and the second binding teeth 72. Consequently, a large load may be applied to the paper bundle T compared to the case where the second binding teeth 72 are moved by a unit other than the screw member 510, such as the support column member 530, when the paper bundle T is pressed between the first binding teeth 71 and the second binding teeth 72.

Third Exemplary Embodiment

Subsequently, a second binding device 52 according to a third exemplary embodiment of the present disclosure will be described. Components that are similar to those according to the first exemplary embodiment discussed above are denoted by similar reference numerals to omit detailed description thereof.

The second binding device 52 according to the third exemplary embodiment is different from the first binding device 51 according to the first exemplary embodiment in the configuration of the transfer portion 560.

For a specific description, the second binding device 52 according to the third exemplary embodiment includes components that are similar to those according to the first exemplary embodiment excluding the transfer portion 560. The transfer portion 560 of the second binding device 52 according to the third exemplary embodiment includes components that are similar to those of the transfer portion 560 according to the second exemplary embodiment except for not including the link mechanism 569 (see FIG. 20 etc.).

In the second binding device 52 according to the third exemplary embodiment, a drive force from the drive motor M is transferred to the second binding teeth 72 via the rotary gears 564. More specifically, a drive force from the drive motor M is transferred to the second binding teeth 72 via the drive gear 561, the rotary gears 564, the large-diameter gear 520, the screw member 510, and the interlocking portion 600. Consequently, the second binding teeth 72 are moved toward the first binding teeth 71, and the second binding teeth 72 are retracted from the first binding teeth 71.

In the first exemplary embodiment discussed above, the information processing section 100 does not vary the rotational speed of the drive motor M. In contrast, the third exemplary embodiment is different from the first exemplary embodiment in that the information processing section 100 varies the rotational speed of the drive motor M in accordance with the moving-direction position of the second binding teeth 72.

Figure 22A:
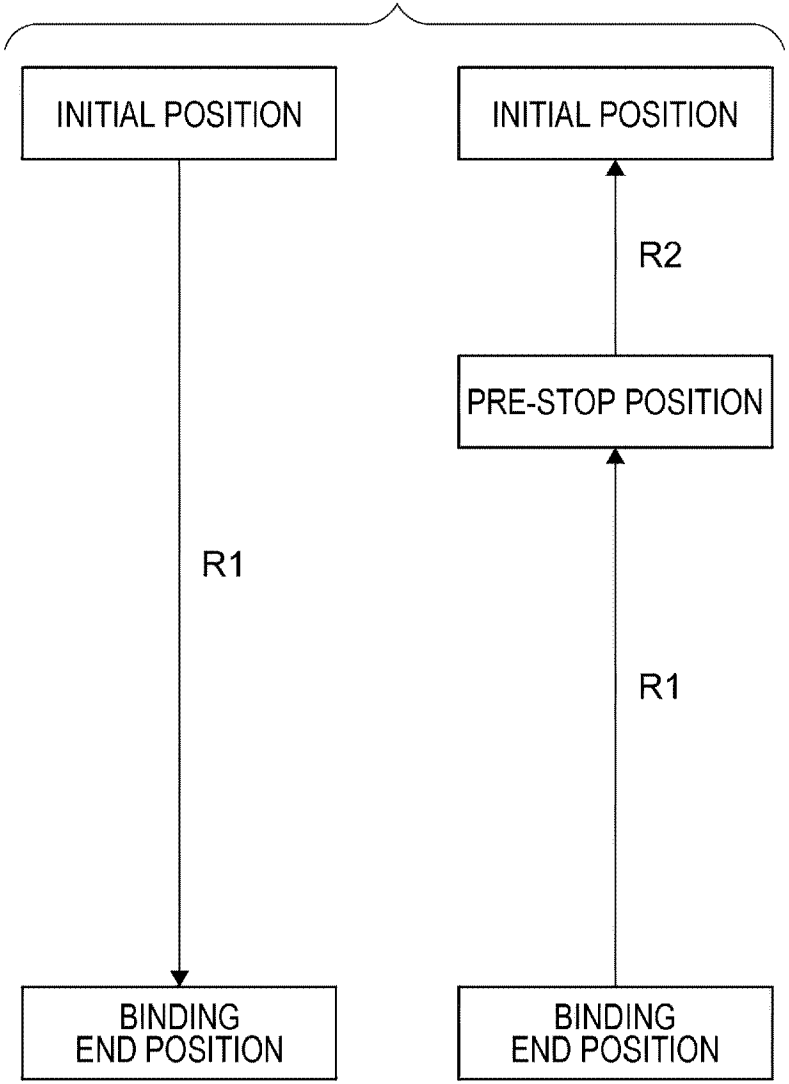
FIGS. 22A and 22B illustrate control for a drive motor performed by an information processing section, illustrating the rotational speed of the drive motor driven by the information processing section.
Figure 22B:
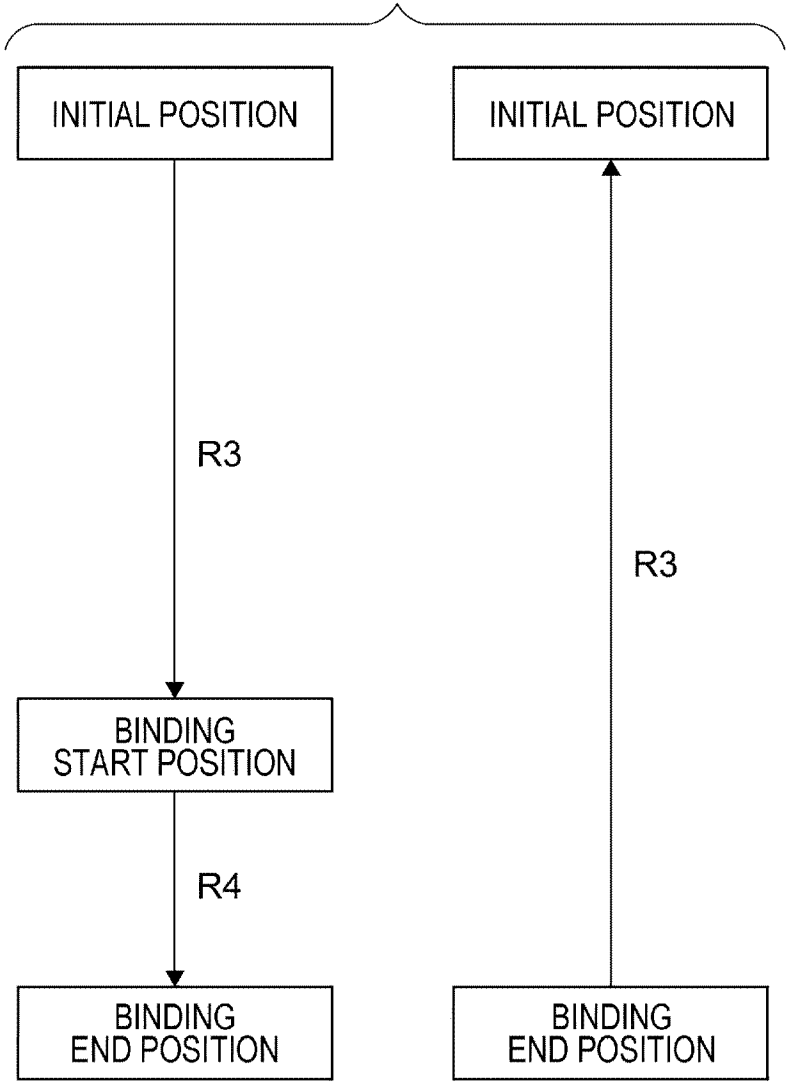

FIGS. 22A and 22B illustrate control for the drive motor M performed by the information processing section 100, illustrating the rotational speed of the drive motor M driven by the information processing section 100. FIG. 22A illustrates a case where a DC motor is used as the drive motor M. FIG. 22B illustrates a case where a stepping motor is used as the drive motor M.

The information processing section 100 performs different control in accordance with the type of the drive motor M.

First, control for the drive motor M performed by the information processing section 100 in the case where a DC motor is used as the drive motor M will be described with reference to FIG. 22A.

To start a binding process with the paper bundle T transported to a space between the first binding teeth 71 and the second binding teeth 72, the information processing section 100 starts drive of the drive motor M to rotate the drive motor M forward at a rotational speed R1 determined in advance. Consequently, the second binding teeth 72 are moved from the initial position discussed above toward the first binding teeth 71 by a drive force transferred from the drive motor M.

The information processing section 100 continuously rotates the drive motor M forward at the rotational speed R1 until the second binding teeth 72 reach the binding end position discussed above.

When the second binding teeth 72 are moved toward the first binding teeth 71 and reach the binding start position discussed above at which the second binding teeth 72 contact the paper bundle T, a load is applied to the second binding teeth 72 with the first binding teeth 71 and the second binding teeth 72 pressing the paper bundle T. Consequently, the moving speed of the second binding teeth 72 moving toward the first binding teeth 71 is occasionally reduced, even in the case where the information processing section 100 does not vary the rotational speed of the drive motor M.

When the second binding teeth 72 reach the binding end position, the information processing section 100 temporarily stops drive of the drive motor M, and thereafter rotates the drive motor M in reverse at the rotational speed R1. Consequently, the second binding teeth 72 are retracted from the first binding teeth 71 and moved toward the initial position by a drive force transferred from the drive motor M.

When the second binding teeth 72 reach the pre-stop position discussed above, the information processing section 100 rotates the drive motor M in reverse at a rotational speed R2 that is lower than the rotational speed R1. In other words, the information processing section 100 reduces the rotational speed of the drive motor M rotated in reverse from the rotational speed R1 to the rotational speed R2.

Consequently, the moving speed of the second binding teeth 72 moved by a drive force from the drive motor M is reduced. More specifically, the moving speed at which the second binding teeth 72 are moved from the pre-stop position toward the initial position is rendered lower than the moving speed at which the second binding teeth 72 are moved from the binding end position to the pre-stop position.

When the second binding teeth 72 reach the initial position, the information processing section 100 stops drive of the drive motor M. Consequently, the second binding teeth 72 are stopped at the initial position.

There is occasionally a time difference since the initial position sensor 850 detects that the second binding teeth 72 have reached the initial position until the information processing section 100 actually stops movement of the second binding teeth 72 by stopping drive of the drive motor M.

In particular, in the case where a DC motor is used as the drive motor M, the time difference since the information processing section 100 stops drive of the drive motor M until the second binding teeth 72 are actually stopped tends to be large, compared to the case where a stepping motor is used as the drive motor M, if the rotational speed of the drive motor M is high. As a result, the position at which the second binding teeth 72 are stopped tends to deviate from the initial position.

In the present exemplary embodiment, in contrast, the information processing section 100 performs control so as to reduce the rotational speed of the drive motor M during a period for which the second binding teeth 72 are moved from the pre-stop position to the initial position.

Subsequently, control for the drive motor M performed by the information processing section 100 in the case where a stepping motor is used as the drive motor M will be described with reference to FIG. 22B.

To start a binding process with the paper bundle T transported to a space between the first binding teeth 71 and the second binding teeth 72, the information processing section 100 starts drive of the drive motor M to rotate the drive motor M forward at a rotational speed R3 determined in advance. Consequently, the second binding teeth 72 are moved from the initial position toward the first binding teeth 71 by a drive force transferred from the drive motor M.

When the second binding teeth 72 reach the binding start position, the information processing section 100 rotates the drive motor M forward at a rotational speed R4 that is lower than the rotational speed R3. In other words, the information processing section 100 reduces the rotational speed of the drive motor M rotated forward from the rotational speed R3 to the rotational speed R4.

Consequently, the moving speed of the second binding teeth 72 moved by a drive force from the drive motor M is reduced. More specifically, the moving speed at which the second binding teeth 72 are moved from the binding start position toward the first binding teeth 71 is rendered lower than the moving speed at which the second binding teeth 72 are moved from the initial position to the binding start position.

When the second binding teeth 72 reach the binding end position, the information processing section 100 temporarily stops drive of the drive motor M, and thereafter rotates the drive motor M in reverse at the rotational speed R3. Consequently, the second binding teeth 72 are retracted from the first binding teeth 71 and moved toward the initial position by a drive force transferred from the drive motor M.

When the second binding teeth 72 reach the initial position, the information processing section 100 stops the drive motor M. Consequently, the second binding teeth 72 are stopped at the initial position.

Consequently, in the case where a stepping motor is used as the drive motor M, the information processing section 100 according to the present exemplary embodiment rotates the drive motor M at the rotational speed R3 when the second binding teeth 72 are moved from the binding end position to the initial position, and does not perform control so as to reduce the rotational speed of the drive motor M.

In general, the precision of stop control for the stepping motor is high compared to the DC motor, and a time difference since the information processing section 100 stops drive of the drive motor M until movement of the second binding teeth 72 is actually stopped is not likely to be caused with the stepping motor. Therefore, in the present exemplary embodiment, the position at which the second binding teeth 72 are stopped is not likely to deviate from the initial position even in the case where the rotational speed of the drive motor M is not reduced when the second binding teeth 72 are moved from the binding end position to the initial position.

In the present exemplary embodiment, the drive motor M is rotated at the rotational speed R3, rather than reducing the rotational speed of the drive motor M, when the second binding teeth 72 are moved from the binding end position to the initial position, which shortens the time required for movement of the second binding teeth 72 compared to the case where the rotational speed of the drive motor M is reduced in the middle of movement of the second binding teeth 72 from the binding end position to the initial position, for example.

Further, in the case where a stepping motor is used as the drive motor M, the information processing section 100 according to the present exemplary embodiment reduces the rotational speed of the drive motor M from the rotational speed R3 to the rotational speed R4 when the second binding teeth 72 are moved from the binding start position to the binding end position. Consequently, when a process of binding the paper bundle T is performed by pressing the paper bundle T using the first binding teeth 71 and the second binding teeth 72, a load that is necessary for the binding process may be applied to the paper bundle T.

The components described above are not limited to those according to the exemplary embodiments described above and modifications thereof, and may be changed without departing from the scope and spirit of the present disclosure. In other words, it is to be understood that the exemplary embodiments and the details may be changed variously without departing from the scope and spirit of the claims.

For example, some of the components described above may be omitted, and other functions may be added to the components described above.

While a plurality of exemplary embodiments have been described above, components included in one exemplary embodiment may be interchanged with components included in a different exemplary embodiment, and components included in one exemplary embodiment may be added to components included in a different exemplary embodiment.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A recording medium processing apparatus comprising:

first teeth to be used in a process of binding a recording medium bundle;

second teeth to be moved toward the first teeth to press the recording medium bundle positioned between the first teeth and the second teeth;

a moving unit that includes a screw moving unit that moves the second teeth with respect to the first teeth by rotating a screw in a circumferential direction, the screw being meshed with an interlocking portion interlocked with the second teeth;

a position detection sensor configured to detect an amount of rotation of the second teeth; and a control unit configured to detect a position of the second teeth based on the detected amount of rotation, wherein a moving speed of the second teeth being moved by the moving unit is varied, and the moving unit further includes a different moving unit that moves the second teeth at a high speed compared to the screw moving unit.

2. The recording medium processing apparatus according to claim 1, further comprising:

a first transfer unit that transfers a drive force to the screw moving unit to rotate the screw in the circumferential direction;

a second transfer unit that transfers a drive force to the screw moving unit to rotate the screw in the circumferential direction at a high speed compared to the first transfer unit; and a switching unit that switches between a state in which the screw is rotated by the first transfer unit and a state in which the screw is rotated by the second transfer unit.

3. The recording medium processing apparatus according to claim 2, wherein the first transfer unit includes a first gear unit that is rotated by a drive force from a drive source to transfer the drive force from the drive source to the screw moving unit, and the second transfer unit includes a second gear unit that is rotated by the drive force from the drive source at a low gear ratio compared to the first gear unit to transfer the drive force from the drive source to the screw moving unit.

4. The recording medium processing apparatus according to claim 1, wherein the different moving unit converts a rotational drive force that rotates the screw into linear motion to transfer the linear motion to the second teeth.

5. The recording medium processing apparatus according to claim 1, further comprising:

a drive source that outputs a drive force for rotating the screw of the moving unit; and a control unit that controls the drive source, wherein the control unit reduces a rotational speed of the drive source in a period determined in advance, of a period for which the second teeth are moved, when the process of binding the recording medium bundle is performed.

6. The recording medium processing apparatus according to claim 5, wherein when the process of binding the recording medium bundle is performed, the second teeth are moved toward the first teeth from an initial position determined in advance, press the recording medium bundle between the first teeth and the second teeth, and thereafter are moved toward the initial position, and the control unit reduces the rotational speed of the drive source in a part of a period before the second teeth reach the initial position after the second teeth press the recording medium bundle between the first teeth and the second teeth.

7. The recording medium processing apparatus according to claim 5, wherein when the process of binding the recording medium bundle is performed, the second teeth are moved toward the recording medium bundle from an initial position determined in advance, press the recording medium bundle between the first teeth and the second teeth, and thereafter are moved toward the initial position, and the control unit reduces the rotational speed of the drive source in a period for which the second teeth press the recording medium bundle between the first teeth and the second teeth.

8. The recording medium processing apparatus according to claim 1, wherein the moving speed of the second teeth is varied in accordance with a position of the second teeth in a direction of movement of the second teeth.

9. The recording medium processing apparatus according to claim 8, wherein the second teeth are moved toward the recording medium bundle from an initial position determined in advance when the process of binding the recording medium bundle is performed, and the moving unit moves the second teeth such that the moving speed of the second teeth being moved from the initial position until the second teeth contacts the recording medium bundle is high compared to the moving speed of the second teeth being moved to press the recording medium bundle.

10. The recording medium processing apparatus according to claim 9, wherein the second teeth are moved to the initial position after the process of binding the recording medium bundle is finished, and the moving unit moves the second teeth such that the moving speed of the second teeth being moved toward the initial position is high compared to the moving speed of the second teeth being moved to press the recording medium bundle.

11. The recording medium processing apparatus according to claim 10, wherein the second teeth are moved to the initial position by way of a pre-stop position determined in advance between the recording medium bundle and the initial position after the process of binding the recording medium bundle is finished, and the moving unit moves the second teeth such that the moving speed of the second teeth being moved from the pre-stop position to the initial position is low compared to the moving speed of the second teeth being moved to the pre-stop position.

12. An image forming system comprising:

an image forming apparatus that forms an image on a recording medium; and a recording medium processing apparatus that performs a process of binding a recording medium bundle formed from a plurality of recording media on which an image has been formed by the image forming apparatus, wherein the recording medium processing apparatus is the recording medium processing apparatus according to claim 1.

13. An image forming system comprising:

an image forming apparatus that forms an image on a recording medium; and a recording medium processing apparatus that performs a process of binding a recording medium bundle formed from a plurality of recording media on which an image has been formed by the image forming apparatus, wherein the recording medium processing apparatus is the recording medium processing apparatus according to claim 2.

14. An image forming system comprising:

an image forming apparatus that forms an image on a recording medium; and a recording medium processing apparatus that performs a process of binding a recording medium bundle formed from a plurality of recording media on which an image has been formed by the image forming apparatus, wherein the recording medium processing apparatus is the recording medium processing apparatus according to claim 3.

15. An image forming system comprising:

an image forming apparatus that forms an image on a recording medium; and a recording medium processing apparatus that performs a process of binding a recording medium bundle formed from a plurality of recording media on which an image has been formed by the image forming apparatus, wherein the recording medium processing apparatus is the recording medium processing apparatus according to claim 4.

16. An image forming system comprising:

an image forming apparatus that forms an image on a recording medium; and a recording medium processing apparatus that performs a process of binding a recording medium bundle formed from a plurality of recording media on which an image has been formed by the image forming apparatus, wherein the recording medium processing apparatus is the recording medium processing apparatus according to claim 5.

17. An image forming system comprising:

an image forming apparatus that forms an image on a recording medium; and a recording medium processing apparatus that performs a process of binding a recording medium bundle formed from a plurality of recording media on which an image has been formed by the image forming apparatus, wherein the recording medium processing apparatus is the recording medium processing apparatus according to claim 6.

18. An image forming system comprising:

an image forming apparatus that forms an image on a recording medium; and a recording medium processing apparatus that performs a process of binding a recording medium bundle formed from a plurality of recording media on which an image has been formed by the image forming apparatus, wherein the recording medium processing apparatus is the recording medium processing apparatus according to claim 7.

19. The recording medium processing apparatus according to claim 1, wherein the control unit is configured to determine a binding operation stage based on the detected position of the second teeth; and control movement of the second teeth based on the determined binding operation stage.

20. A recording medium processing apparatus comprising:

first teeth to be used in a process of binding a recording medium bundle;

second teeth to be moved toward the first teeth to press the recording medium bundle positioned between the first teeth and the second teeth;

a moving unit that includes a screw moving unit that moves the second teeth with respect to the first teeth by rotating a screw in a circumferential direction, the screw being meshed with an interlocking portion interlocked with the second teeth;

a position detection sensor configured to detect an amount of rotation of the second teeth; and a control unit configured to detect a position of the second teeth based on the detected amount of rotation, wherein a moving speed of the second teeth being moved by the moving unit is varied, and the recording medium processing apparatus further comprises a first transfer unit that transfers a drive force to the screw moving unit to rotate the screw in the circumferential direction;

a second transfer unit that transfers a drive force to the screw moving unit to rotate the screw in the circumferential direction at a high speed compared to the first transfer unit; and a switching unit that switches between a state in which the screw is rotated by the first transfer unit and a state in which the screw is rotated by the second transfer unit.

* * * * *